US011388523B2

(12) United States Patent
Corynen

(10) Patent No.: US 11,388,523 B2
(45) Date of Patent: Jul. 12, 2022

(54) INERTIAL EXCITERS, DRIVE UNITS AND LOUDSPEAKERS

(71) Applicant: PSS BELGIUM NV, Dendermonde (BE)

(72) Inventor: David Corynen, Dendermonde (BE)

(73) Assignee: PSS BELGIUM NV, Dendermonde (BE)

( * ) Notice: Subject to any disclaimer, the term of this patent is extended or adjusted under 35 U.S.C. 154(b) by 0 days.

(21) Appl. No.: 17/296,016

(22) PCT Filed: Dec. 12, 2019

(86) PCT No.: PCT/EP2019/084950
§ 371 (c)(1),
(2) Date: May 21, 2021

(87) PCT Pub. No.: WO2020/126847
PCT Pub. Date: Jun. 25, 2020

(65) Prior Publication Data

US 2022/0038824 A1 Feb. 3, 2022

(30) Foreign Application Priority Data

Dec. 17, 2018 (GB) ..... 1820557
Jun. 13, 2019 (GB) ..... 1908461

(51) Int. Cl.
*H04R 9/06* (2006.01)
*H04R 7/04* (2006.01)
(Continued)

(52) U.S. Cl.
CPC ..... *H04R 9/066* (2013.01); *H04R 7/045* (2013.01); *H04R 7/20* (2013.01); *H04R 9/043* (2013.01);
(Continued)

(58) Field of Classification Search
CPC ..... H04R 9/043; H04R 9/066; H04R 7/045; H04R 7/20; H04R 31/003; H04R 2307/207; H04R 2400/07
See application file for complete search history.

(56) References Cited

U.S. PATENT DOCUMENTS 4,354,067 A 10/1982 Yamada et al.
4,506,117 A 3/1985 Fresard
(Continued)

FOREIGN PATENT DOCUMENTS

DE 102004009902 A1 2/2005
EP 0912072 A1 4/1999

OTHER PUBLICATIONS

ISA/EP, International Search Report and Written Opinion for corresponding PCT Patent Application No. PCT/EP2019/084950, dated Jan. 31, 2020, 9 pages.
(Continued)

*Primary Examiner* — Sunita Joshi
(74) *Attorney, Agent, or Firm* — NK Patent Law

(57) ABSTRACT

An inertial exciter for use with an acoustic radiator, the inertial exciter comprising: a magnet assembly including a magnet unit configured to provide a magnetic field in an air gap, wherein the air gap extends around a movement axis of the inertial exciter; a coil assembly including: an attachment portion configured to provide an attachment between the coil assembly and the acoustic radiator; a voice coil; a voice coil former which extends from the attachment portion into the air gap.

24 Claims, 18 Drawing Sheets

(51) Int. Cl.
*H04R 7/20* (2006.01)
*H04R 9/04* (2006.01)
*H04R 31/00* (2006.01)

(52) U.S. Cl.
CPC ..... *H04R 31/003* (2013.01); *H04R 2307/207* (2013.01); *H04R 2400/07* (2013.01)

(56) References Cited

U.S. PATENT DOCUMENTS 4,550,428 A 10/1985 Yanagishima et al.
4,675,907 A 6/1987 Itagaki et al.
4,750,208 A 6/1988 Yamada et al.
5,734,132 A * 3/1998 Proni ..... H04R 7/20 381/407
6,088,466 A 7/2000 Proni
6,095,280 A 8/2000 Proni
6,618,487 B1 9/2003 Azima et al.
6,965,679 B1 11/2005 Lopez Bosio et al.
7,372,968 B2 5/2008 Buos et al.
8,247,930 B2 8/2012 Yamagishi
9,621,994 B1 4/2017 Bongiovi et al.
2004/0197007 A1 10/2004 Onuma
2005/0111690 A1 5/2005 Onuma et al.
2005/0180587 A1 8/2005 Lopez Bosio et al.
2005/0271241 A1 12/2005 Watanabe
2006/0280330 A1 12/2006 Watanabe
2017/0280216 A1* 9/2017 Lee ..... H04R 9/066

OTHER PUBLICATIONS

IPO; Examination Report for UK Patent Application No. GB1908461.5, dated Apr. 22, 2022, 5 pages.

* cited by examiner

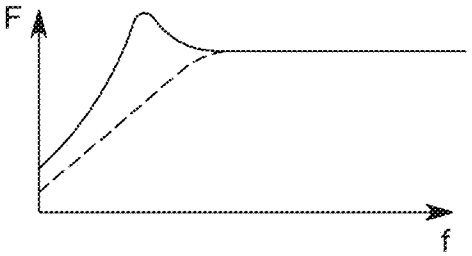
FIG. 3A.II
(PRIOR ART)
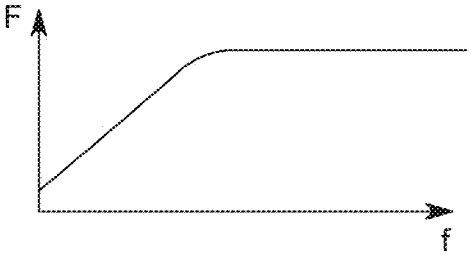
FIG. 3B.II
(PRIOR ART)
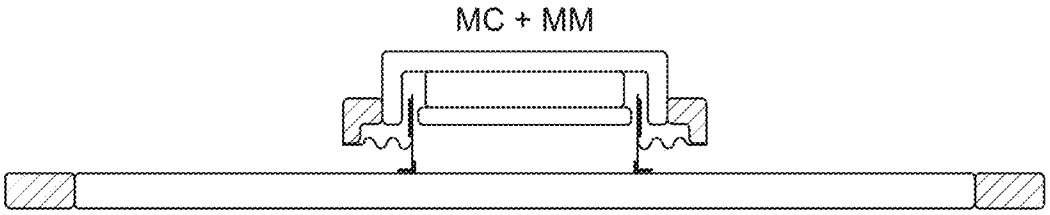
FIG. 3A.I
(PRIOR ART)
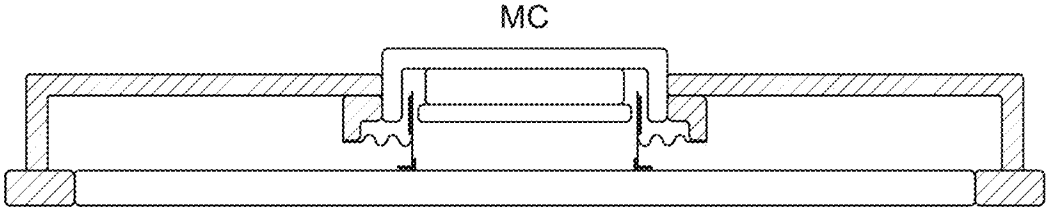
FIG. 3B.I
(PRIOR ART)

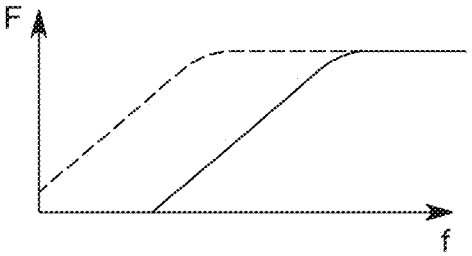
FIG. 3C.II
(PRIOR ART)
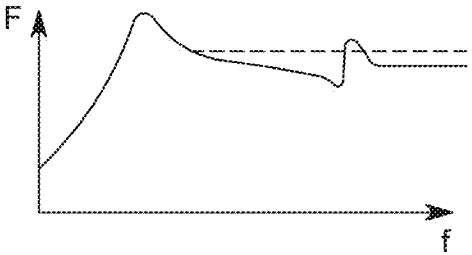
FIG. 3D.II
(PRIOR ART)
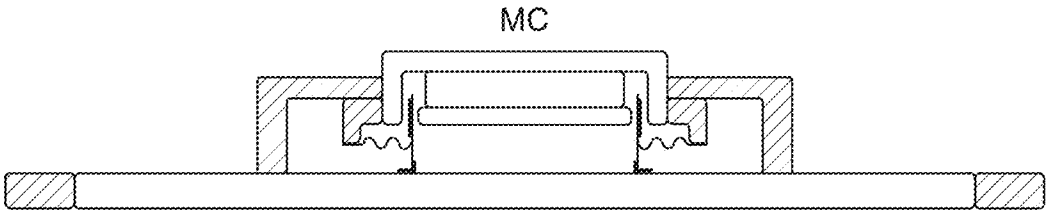
FIG. 3C.I
(PRIOR ART)
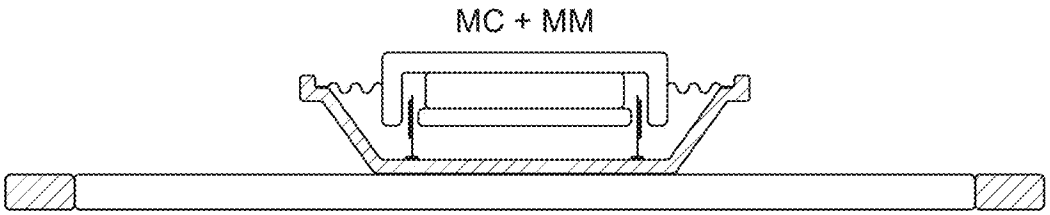
FIG. 3D.I
(PRIOR ART)

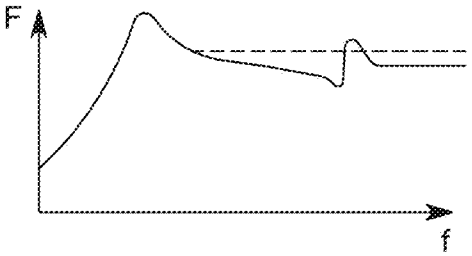
FIG. 3E.II
(PRIOR ART)
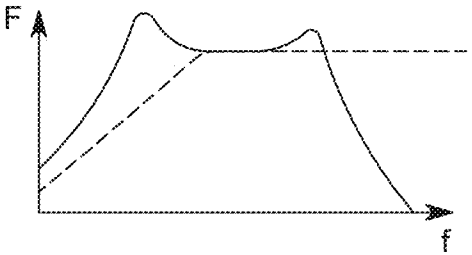
FIG. 3F.II
(PRIOR ART)
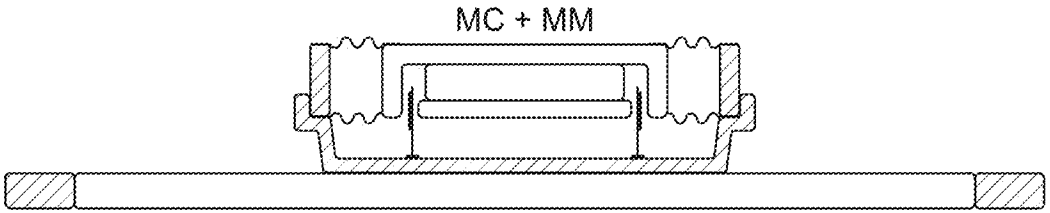
FIG. 3E.I
(PRIOR ART)
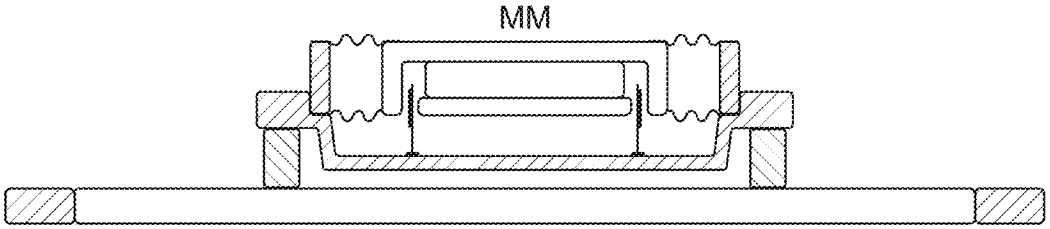
FIG. 3F.I
(PRIOR ART)

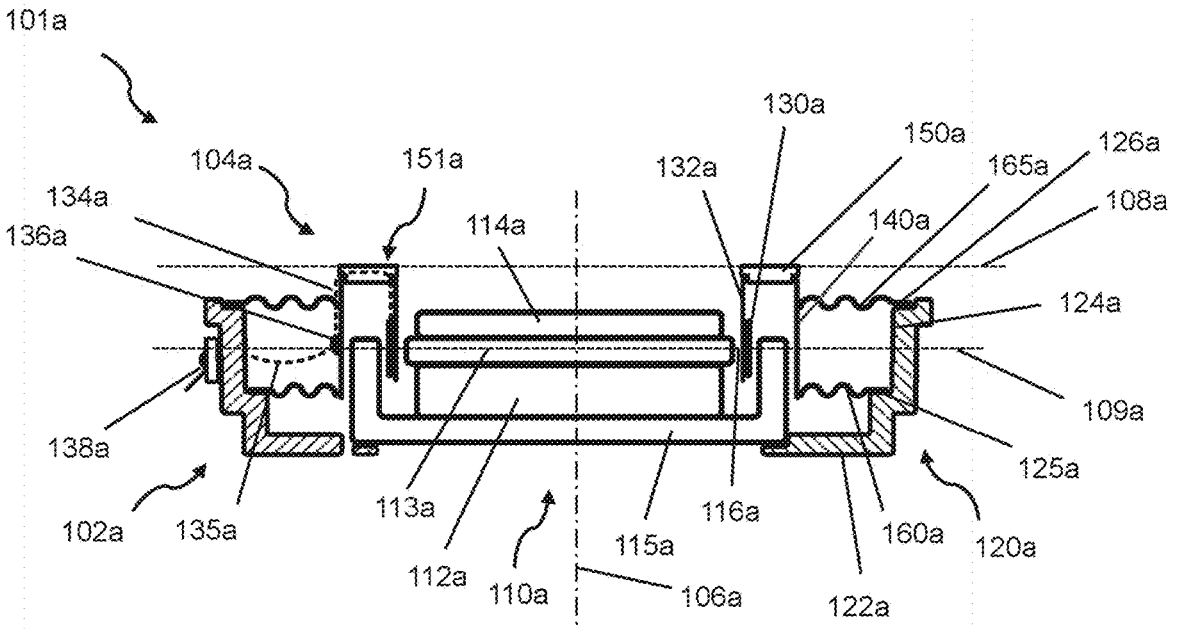
Fig. 4(a)(i)
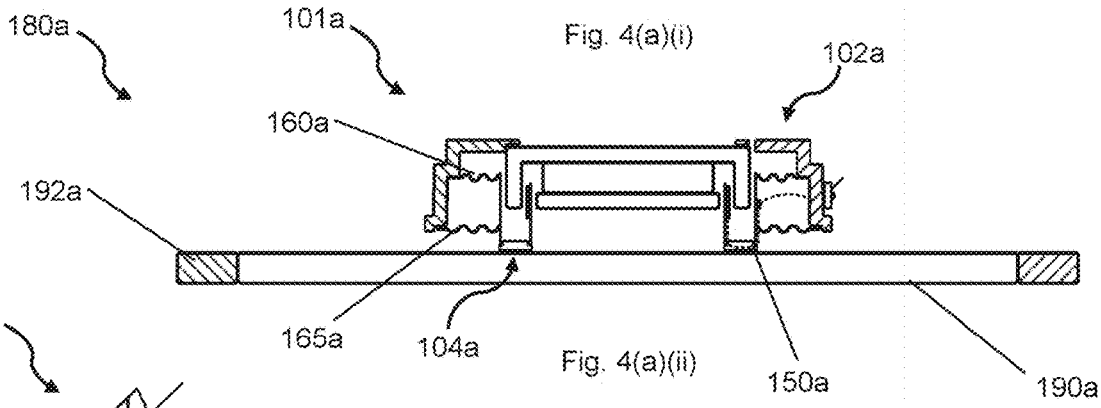
Fig. 4(a)(ii)
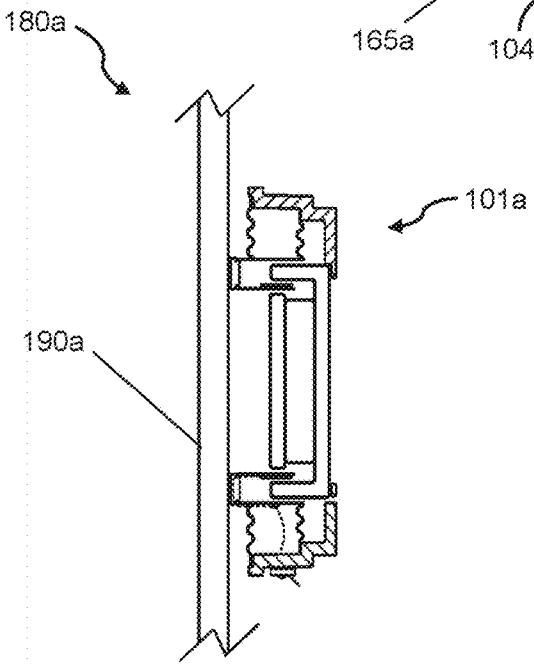
Fig. 4(a)(iii)
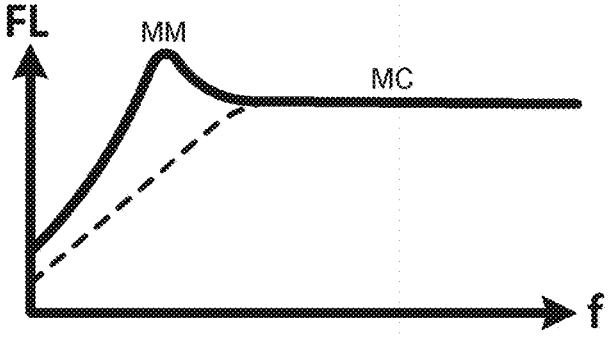
Fig. 4(a)(iv)

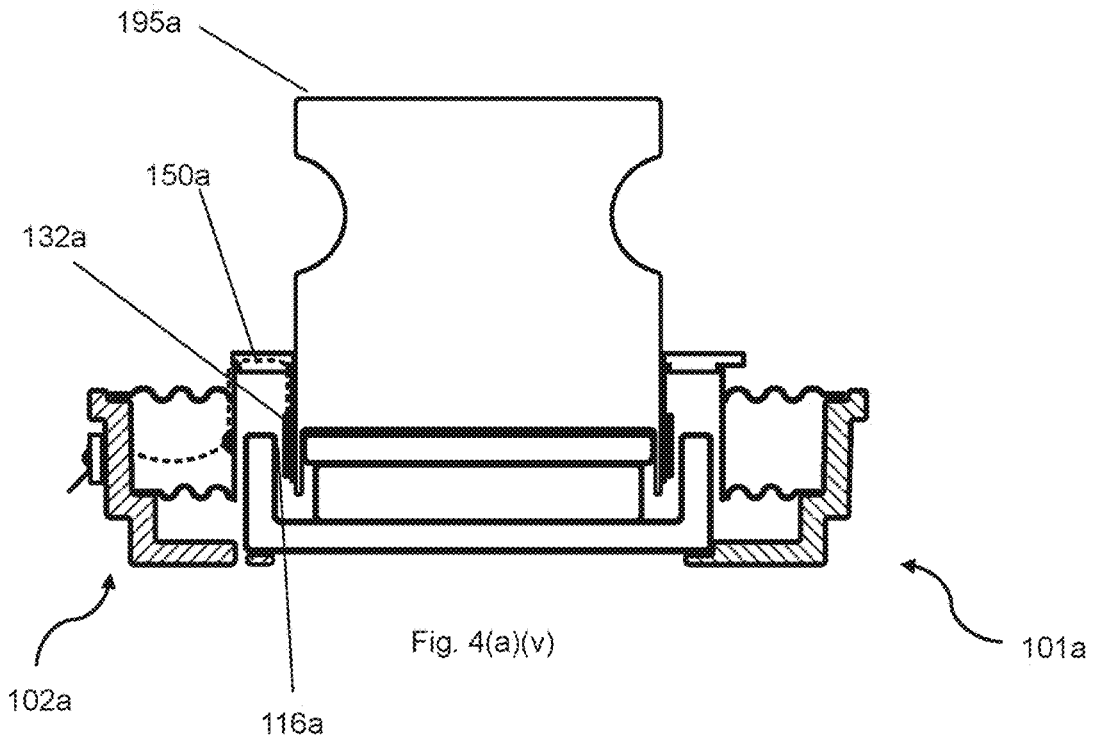
Fig. 4(a)(v)
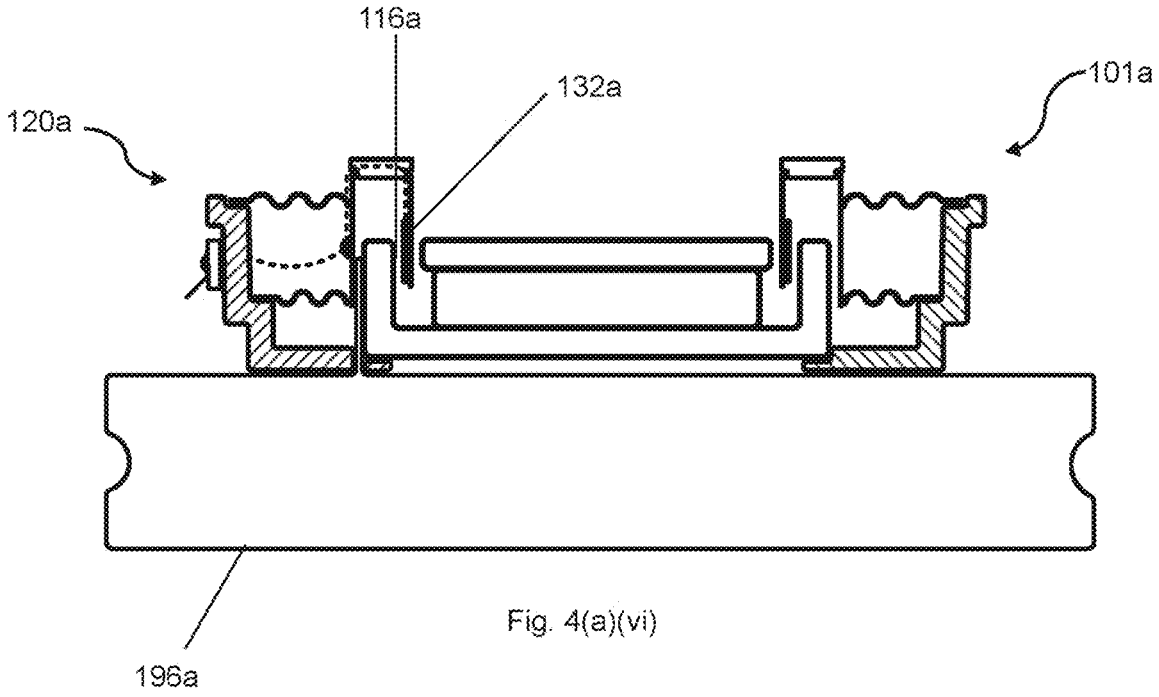
Fig. 4(a)(vi)

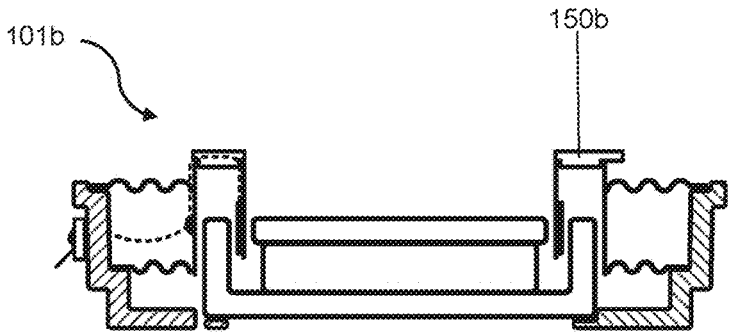
Fig. 4(b)(i)
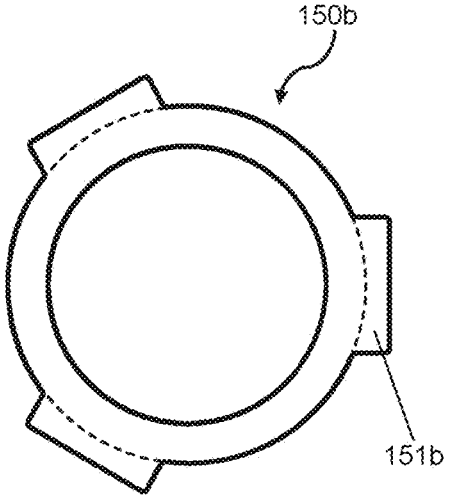
Fig. 4(b)(ii)
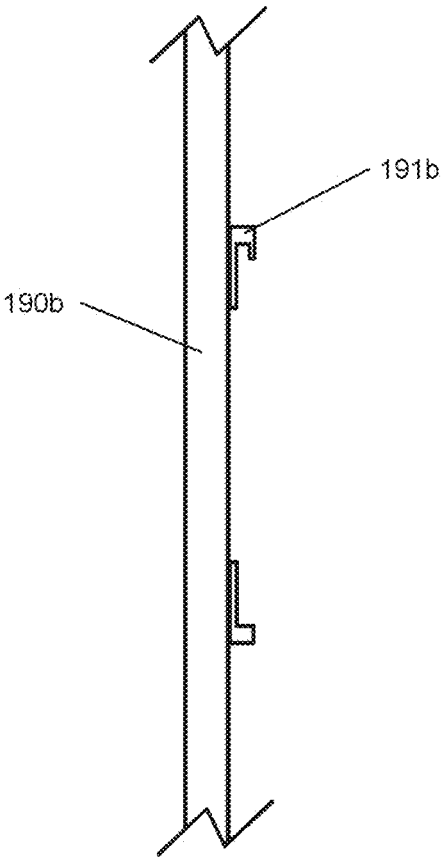
Fig. 4(b)(iii)
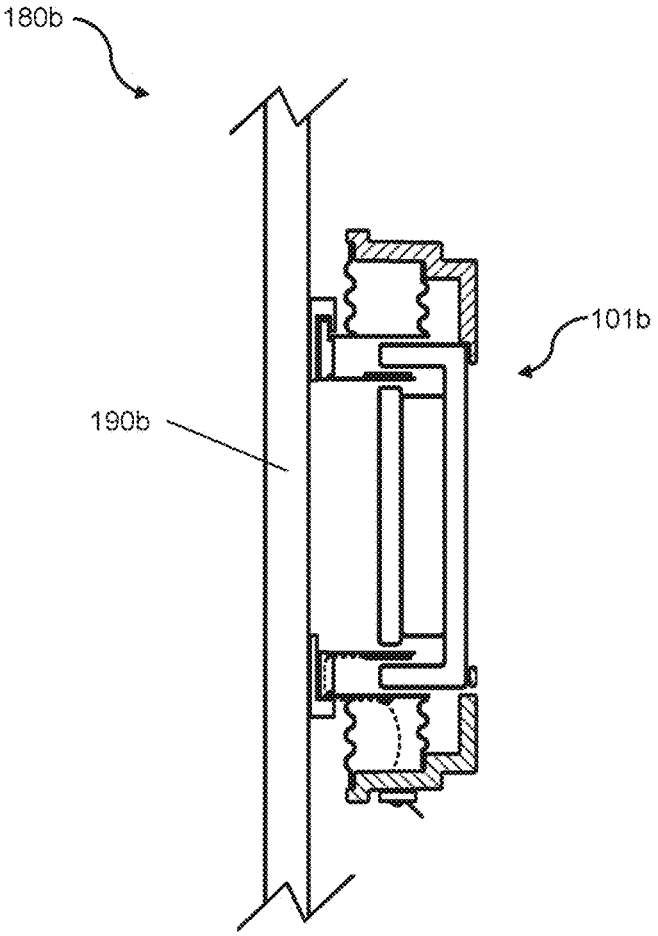
Fig. 4(b)(iv)

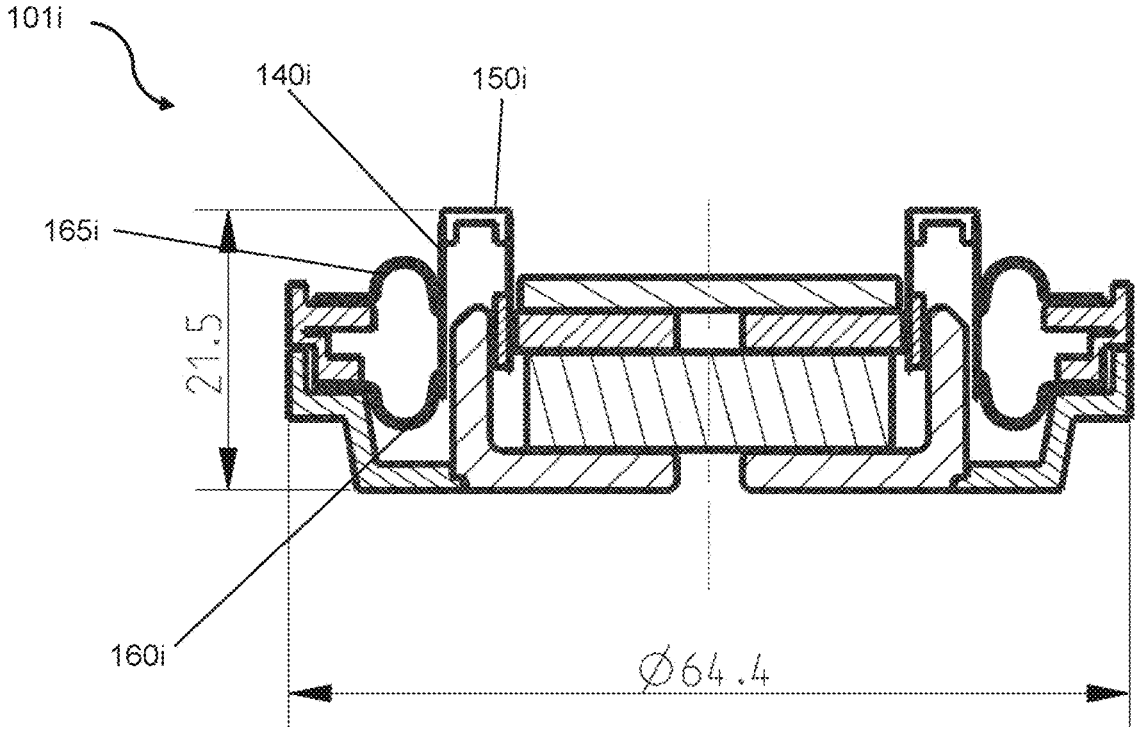
Fig. 4(i)(i)
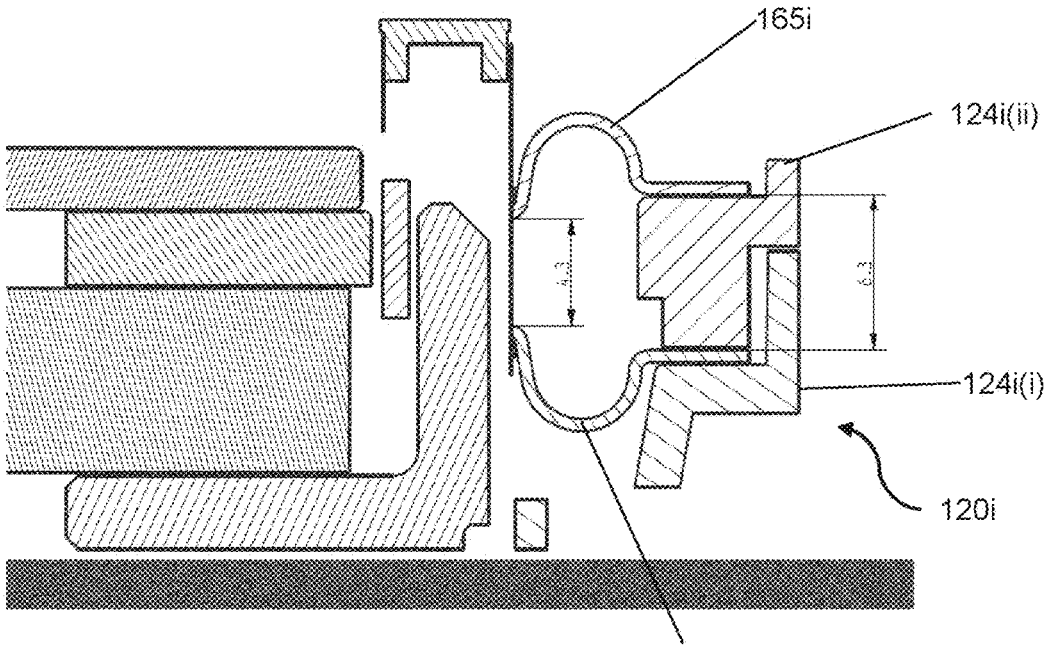
Fig. 4(i)(ii)

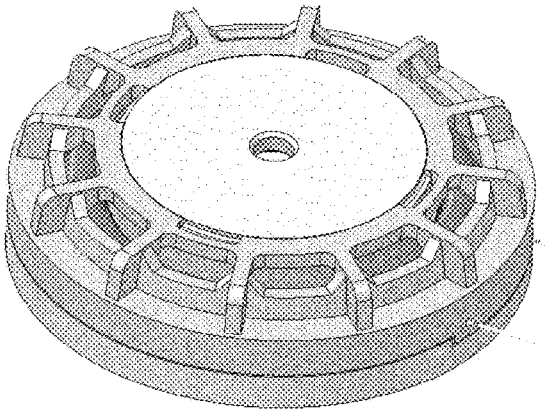
Fig. 4(i)(iii)
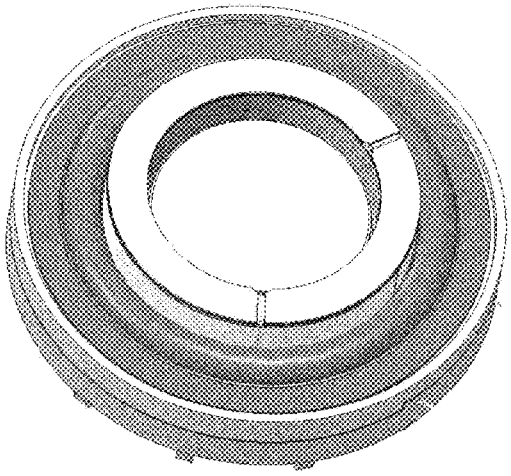
Fig.4(i)(iv)
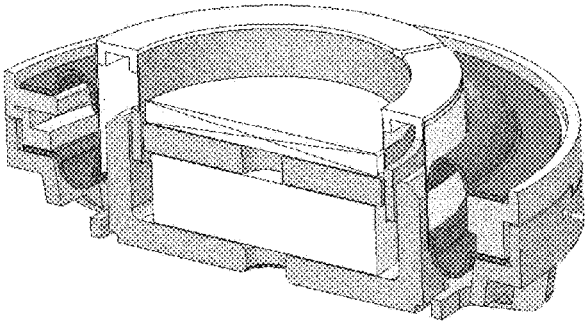
Fig.4(i)(v)
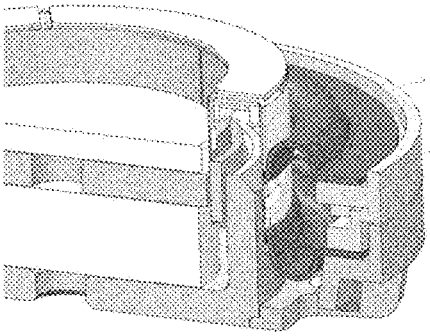
Fig. 4(i)(vi)
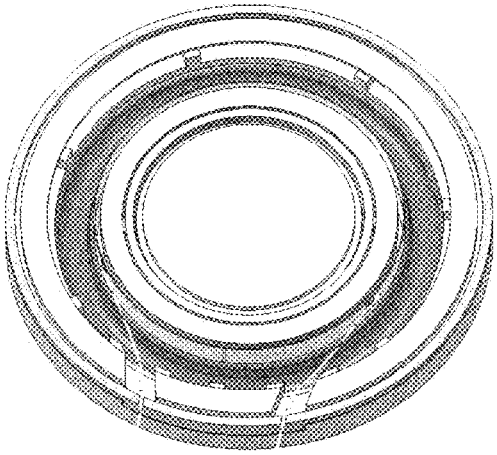
Fig. 4(i)(vii)
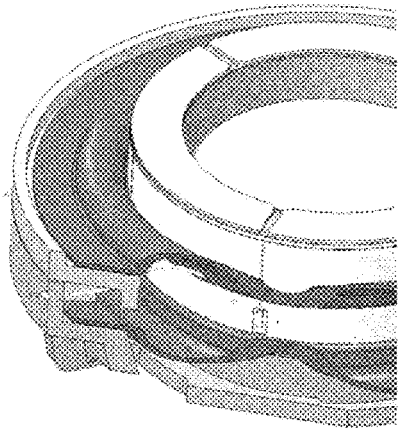
Fig.4(i)(viii)

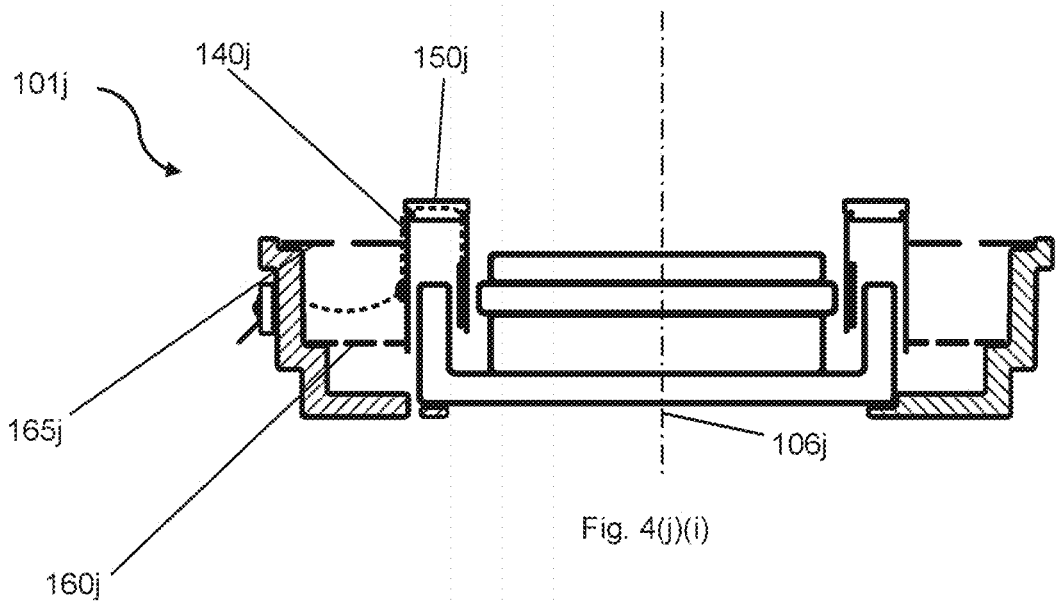
Fig. 4(j)(i)
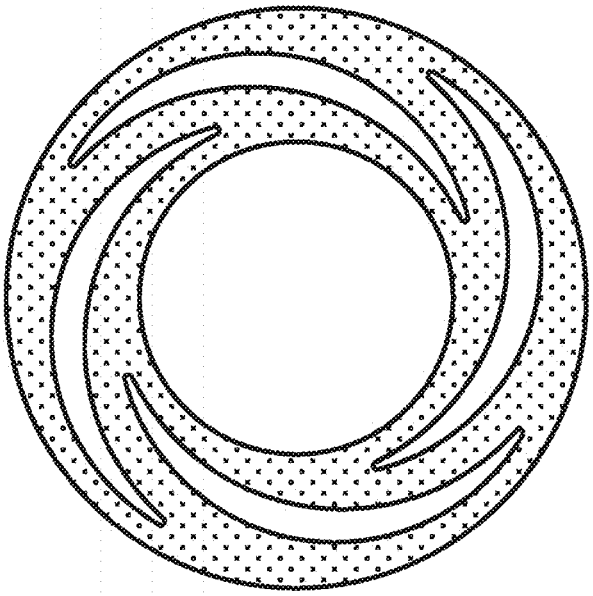
Fig. 4(j)(ii)

INERTIAL EXCITERS, DRIVE UNITS AND LOUDSPEAKERS

Cross Reference to Related Applications

This application is a U.S. National Stage Application of International Patent Application No. PCT/EP2019/084950 entitled "INERTIAL EXCITERS, DRIVE UNITS AND LOUDSPEAKERS" filed on 12 Dec. 2019, which claims priority from GB1820557.5 entitled "INERTIAL EXCITER" filed 17 Dec. 2018 and GB1908461.5 entitled "INERTIAL EXCITERS, DRIVE UNITS AND LOUDSPEAKERS" filed 13 Jun. 2019, the contents and elements of which are herein incorporated by reference for all purposes.

This application claims priority from GB1820557.5 filed 17 Dec. 2018 and GB1908461.5 filed 13 Jun. 2019, the contents and elements of which are herein incorporated by reference for all purposes.

FIELD OF THE INVENTION

The present invention relates to an inertial exciter, to a loudspeaker including an inertial exciter, to a drive unit, and also to a loudspeaker including a drive unit. Corresponding methods are also disclosed.

BACKGROUND

Traditional loudspeakers, an example of which is shown in FIG. 1(*a*), typically include an acoustic radiator, typically referred to as a diaphragm, suspended from a frame mounted in a baffle or loudspeaker enclosure. Sound is produced as a result of movement of the diaphragm, actuated by a voice coil attached to the diaphragm, which interacts with a magnet system attached to the frame. The baffle or loudspeaker enclosure acts to inhibit cancellation between sound produced by the front and rear faces of the diaphragm.

Inertial exciters, an example of which is shown in FIG. 1(*b*), typically are devices which are configured to attach to an acoustic radiator such as a panel or soundboard, and which are configured to apply inertial force to the acoustic radiator so as to cause the acoustic radiator to vibrate to produce sound. Inertial exciters are typically used in automotive, aviation and consumer products.

Loudspeakers incorporating inertial exciters are well known, with examples being disclosed in, for example [1]-[12].

Acoustical exciters are capable of transmitting a wide bandwidth of mechanical vibration energy into acoustic radiators, typically panels or walls that are configured to sustain that vibration energy across their surface to produce acoustic output. For a loudspeaker incorporating an inertial exciter, the frequency spectrum of interest (the frequency spectrum across which the loudspeaker is able to produce sound) may be the audible range (20 Hz-20 kHz).

In order to produce sound over a wide bandwidth, inertial exciters typically need to have a coil assembly (the part of the inertial exciter that includes the voice coil) that has a low mass and is very stiff so as to maximize the efficiency across the audio bandwidth. Whereas the magnet assembly (the part of the inertial exciter that includes the magnet system) can have a much higher mass (and generally will have a higher mass in practice).

The mechanical fixation of the exciter to the acoustic panel requires special attention: when one wants to make use of moving coil (MC) excitation combined with moving magnet (MM) excitation (these types of excitation are discussed in more detail below), ideally the exciter is mounted to the acoustic radiator only via the coupler, i.e. with the magnet assembly being suspended from the acoustic radiator via the coil assembly, thereby leaving the magnet system freely suspended.

FIG. 2(*a*) shows a loudspeaker 1 incorporating a wide bandwidth inertial exciter implementing principles derived from the prior art. FIG. 2(*b*) is a graph showing force level vs frequency for the loudspeaker shown in FIG. 2(*a*).

In this example, a magnet assembly 2 including a magnet unit 10 and a frame 12 is suspended from an acoustic radiator 90 via a coil assembly including a voice coil 30 and a voice coil former 32. The voice coil 30 sits in an air gap 16 of the magnet unit 10 when the exciter 1 is at rest The voice coil will generate a force F according to:

$$F=BLI$$

where B is magnetic field, L is wire length and I is electric current (standard units).

The inertia of the magnet assembly 2 (which is typically significantly heavier than the voice coil assembly 4) allows the voice coil assembly 4 to transmit vibrational energy to the acoustic radiator 90. Excitation of the acoustic radiator 90 caused by movement of the voice coil assembly is referred to herein as "moving coil" or "MC" excitation.

Where the magnet assembly 2 is suspended from the acoustic radiator 90 via the coil assembly 4 (as in the example shown in FIG. 2(*a*)), resonance of the magnet assembly 2 is able to give additional vibrational energy to the acoustic radiator 90 around the resonant frequency of the magnet assembly 2. The resonant frequency of the magnet assembly 2 is defined by the mass of the magnet assembly 2 and the compliance of the suspension 60 from which the magnet assembly 2 is suspended. Excitation of the acoustic radiator 90 caused by resonance of the magnet assembly 2 is referred to herein as "moving magnet" or "MM" excitation.

As shown in FIG. 2(*b*), MM excitation provides a force boost at low frequencies (labelled "MM" in FIG. 2(*b*)), which is an advantage of systems in which the exciter is mounted to the acoustic radiator only via the coupler, as in the example of FIG. 2(*a*).

The force level provided by MC excitation (labelled "MC" in FIG. 2(*b*)) is boosted by the voice coil having a low weight and being very stiff.

The present inventor has observed a problem with the loudspeaker illustrated in FIG. 2(*a*). This problem is illustrated by FIG. 2(*c*).

In detail, when mounting the acoustic panel 90 (to which the wide bandwidth inertial exciter 1 is attached) vertically, e.g. in an interior door panel of a car, the gravitational force on the magnet assembly 2 tends to rotate its position relative to the voice coil 4 assembly over time. This is due to the compliance of the single suspension 60 (in this case a spider) that is configured to position the voice coil 30 in the air gap 16 (and does this job very well), but is not configured to inhibit rotation of the magnet assembly 2 relative to the voice coil assembly 4 when the acoustic radiator 90 is vertically mounted, e.g. as may be the case in a car door.

The prior art teaches some possible solutions to this problem, some of which are summarized as follows:

Solution A as shown in FIG. 3(*a*)(*i*) and FIG. 3(*a*)(*ii*) ("Free magnet system")

Good MC & MM operation; Minimal additional mass for MC; Similar to [1];

Problem: Motor mass on single suspension makes it unstable regarding buckling as depicted in FIG. 2(*c*)

Solution B as shown in FIG. 3(*b*)(*i*) and FIG. 3(*b*)(*ii*) ("Grounded magnet system")

Stable magnet system; Similar to [13] and classic loudspeaker;

Problem: Large bracket for large panels, No MM excitation benefit, Not an inertial exciter design Solution C as shown in FIG. 3(*c*)(*i*) and FIG. 3(*c*)(*ii*) ("Bracket to panel")

Stable magnet system; Similar to [6], [7], [11], [12]

Problem: Influence of panel acoustics, No MM benefit

Solution D as shown in FIG. 3(*d*)(*i*) and FIG. 3(*d*)(*ii*) ("Centrally suspended motor")

MC and MM excitation; Reasonably stable; Similar to [4]

Problem: Additional mass for MC operation, Breakup of large coupler causes a step in force profile Solution E as shown in FIG. 3(*e*)(*i*) and FIG. 3(*e*)(*ii*) ("Double suspended motor")

MC and MM excitation; Stable motor suspension; Similar to [8], [9], [10]

Problem: Additional mass for MC operation, Breakup of large coupler causes a step in force profile Solution F as shown in FIG. 3(*f*)(*i*) and FIG. 3(*f*)(*ii*) ("Shaker")

Only MM operation (for use as a shaker); Stable motor suspension

Problem: Not a wide bandwidth

Solution F uses an inertial exciter as a shaker to transmit a small bandwidth of mechanical vibration energy into structures such as a seat in a car or in a cinema to augment the experience via tactile stimulus. Generally, the frequency spectrum in which this seems enjoyable is very limited, e.g. 30 Hz-80 Hz. The design of shakers is less complicated as compared to acoustic exciters because they rely solely on the inertial vibration energy of the moving magnet system (MM) since their scope is to transfer only low frequency vibration. The fixation of such shaker to the panel is also less critical and may involve heavier constructions without compromising performance. Of course a wide bandwidth inertial exciter (with a freely suspended magnet system as in solutions A, D, E) can also be used solely as a shaker.

The inventor has observed that it is difficult to make an inertial exciter that successfully inhibits rotation of the magnet assembly relative to the voice coil assembly whilst allowing MM excitation and without adding significant weight to the voice coil assembly. Thus, it is difficult to produce an inertial exciter having good sound reproduction over a wideband bandwidth, without encountering rotation issues when the acoustic radiator is mounted vertically, e.g. as might be the case in a car door.

The present invention has been devised in light of the above considerations.

SUMMARY OF THE INVENTION

A first aspect of the invention provides:

An inertial exciter for use with an acoustic radiator, the inertial exciter comprising:

a magnet assembly including a magnet unit configured to provide a magnetic field in an air gap, wherein the air gap extends around a movement axis of the inertial exciter;

a coil assembly including:

an attachment portion configured to provide an attachment between the coil assembly and the acoustic radiator;

a voice coil;

a voice coil former which extends from the attachment portion into the air gap, wherein the voice coil is mounted to the voice coil former so that the voice coil sits in the air gap when the inertial exciter is at rest;

a tubular member, which is positioned radially outwardly of the voice coil former with respect to the movement axis, and which overlaps the voice coil former along at least a portion of the movement axis;

at least one suspension attached to the tubular member and a part of the magnet assembly positioned radially outwardly of the tubular member so that, when the coil assembly is attached to the acoustic radiator via the attachment portion, the magnet assembly is suspended from the acoustic radiator via the coil assembly by the at least one suspension.

The tubular member, by being positioned radially outwardly of the voice coil former (preferably also of the air gap) with respect to the movement axis, the tubular member facilitates the attachment of the at least one suspension, preferably two suspensions, to the part of the magnet assembly positioned radially outwardly of the tubular member.

The movement axis may be defined as an axis along which the voice coil assembly is configured to move relative to the magnet assembly when the inertial exciter is activated by supplying electrical current carrying an audio signal to the voice coil.

The inertial exciter may be considered to be at rest when electrical current is not supplied to the voice coil.

Note that in order for the magnet assembly to be suspended from the acoustic radiator via the coil assembly, the magnet assembly should only be attached to the acoustic radiator via the coil assembly, i.e. with no rigid attachment between the magnet assembly and the acoustic radiator.

Preferably, the inertial exciter comprises:

a first suspension attached to the tubular member and the part of the magnet assembly positioned radially outwardly of the tubular member; and a second suspension, separated from the first suspension in a direction extending parallel to the movement axis, wherein the second suspension is either: attached to the tubular member and the part of the magnet assembly positioned radially outwardly of the tubular member or is attached to the voice coil former and a part of the magnet assembly positioned radially inwardly of the voice coil former.

The use of two suspensions, separated in the direction of the movement axis, helps to significantly reduce the rotation described above with respect to FIG. 2(*c*) and maintain good performance without substantially increasing the weight of the coil assembly, noting that the tubular member allows a large separation of the first and second suspensions, and also noting that the tubular member has an inherently stiff shape and so can be formed from lightweight material.

For a typical application, the distance between locations at which the two suspensions attach to the part of the magnet assembly positioned radially outwardly of the tubular member may be at least 3 mm, more preferably at least 5 mm, more preferably at least 6 mm as measured in a direction extending parallel to the movement axis. A skilled person would appreciate that actual distances will vary in practice depending on various factors including weight of the magnet assembly (larger weight requires larger distance) and design limitations (e.g. space in aperture in which loudspeaker is to be installed).

The magnet assembly may include a frame to which the magnet unit is attached, wherein the part of the magnet assembly positioned radially outwardly of the tubular member (to which the at least one suspension is attached) is a part of the frame.

The part of the magnet assembly positioned radially outwardly of the tubular member (to which the at least one suspension is attached) could, for example, be a rim of the frame.

The part of the magnet assembly positioned radially outwardly of the tubular member (to which the at least one suspension is attached) may include a respective ledge for the/each suspension attached to the part of the magnet assembly positioned radially outwardly of the tubular member, thereby facilitating attachment of the suspension element(s) to the part of the magnet assembly positioned radially outwardly of the tubular member.

The frame (included in the magnet assembly) may include apertures configured to allow a jig to be inserted to centre the tubular member during assembly.

Some optional features of the inertial exciter described herein are described with reference to:

- a first plane perpendicular to the movement axis which extends through the attachment portion;
- a second plane perpendicular to the movement axis which extends through the air gap.

Features described with reference to the first and second planes are preferably described with respect to the inertial exciter when the inertial exciter is at rest. As noted above, the inertial exciter may be considered to be at rest when electrical current is not supplied to the voice coil.

The part of the magnet assembly positioned radially outwardly of the tubular member (to which the at least one suspension is attached) may include:

- a proximal portion, wherein the proximal portion of the part of the magnet assembly positioned radially outwardly of the tubular member is located between the first plane and the second plane; and
- a distal portion, wherein the distal portion of the part of the magnet unit positioned radially outwardly of the tubular member is located is on an opposite side of the second plane from the proximal portion (of the part of the magnet assembly positioned radially outwardly of the tubular member).

The magnet assembly may include a part of the magnet assembly positioned radially inwardly of the voice coil former, wherein the part of the magnet assembly position radially inwardly of the voice coil former includes:

- a proximal portion, wherein the proximal portion of the part of the magnet assembly positioned radially inwardly of the voice coil former is located between the first plane and the second plane; and
- a distal portion, wherein the distal portion of the part of the magnet unit positioned radially inwardly of the voice coil former is located is on an opposite side of the second plane from the proximal portion (of the part of the magnet assembly positioned radially inwardly of the voice coil former).

The part of the magnet assembly positioned radially inwardly of the voice coil former may include part of the magnet unit. The proximal portion of the part of the magnet assembly positioned radially inwardly of the voice coil former may for example include part of the magnet unit, e.g. an extra magnet 114*a* as shown in FIG. 4(*a*)(*i*). The distal portion of the part of the magnet assembly positioned radially inwardly of the voice coil former may for example include part of the magnet unit, e.g. a main magnet 112*a* as shown in FIG. 4(*a*)(*i*).

The tubular member may include:

- a proximal portion, wherein the proximal portion of the tubular member is located between the first plane and the second plane;
- a distal portion, wherein the distal portion of the tubular member is located is on an opposite side of the second plane from the proximal portion (of the tubular member).

The voice coil former may include:

- a proximal portion, wherein the proximal portion of the voice coil former is located between the first plane and the second plane;
- a distal portion, wherein the distal portion of the voice coil former is located on an opposite side of the second plane from the proximal portion (of the voice coil former).

Note that if the tubular member has the distal portion (as described above), this allows the tubular member to reach past the air gap on the outside of the magnet unit, and allows the first and second suspensions to be separated by a larger distance, compared with an arrangement in which the two suspensions are attached to the voice coil former.

Preferably, the first suspension is attached to the distal portion of the tubular member and the distal portion of the part of the magnet assembly positioned radially outwardly of the tubular member.

Preferably, the second suspension is attached to the proximal portion of the tubular member and the proximal portion of the part of the magnet assembly positioned radially outwardly of the tubular member.

However, the second suspension could potentially instead attach to the proximal portion of the voice coil former and the proximal portion of the part of the magnet assembly positioned radially inwardly of the voice coil former, whilst still allowing a wide separation between the first and second suspensions, thereby still helping to reduce the rotation discussed above with reference to FIG. 2(*c*).

Preferably, the inertial exciter comprises both:

- a first suspension that is attached to the distal portion of the tubular member and the distal portion of the part of the magnet assembly positioned radially outwardly of the tubular member; and
- a second suspension that is attached to the proximal portion of the tubular member and the proximal portion of the part of the magnet assembly positioned radially outwardly of the tubular member.

This arrangement allows the first and second suspensions to have a particularly large space between them, which helps to reduce the rotation discussed above with reference to FIG. 2(*c*).

In this arrangement, the inertial exciter may optionally include a third suspension that is attached to the proximal portion of the voice coil former and the proximal portion of the part of the magnet assembly positioned radially inwardly of the voice coil former (e.g. as shown in FIG. 5(*b*)).

The tubular member preferably extends around the magnet unit.

The tubular member preferably overlaps the magnet unit along at least a portion of the movement axis.

The tubular member may be shaped to include the attachment portion, e.g. so as to facilitate direct gluing (or some other attachment) of the tubular member to the acoustic radiator.

The tubular member may be shaped to include the attachment portion and the voice coil former.

The tubular member may include or be attached to a surface extending outwardly in a radial direction (with respect to the movement axis) from the distal portion of the tubular member to provide a surface for attaching the tubular member to the first suspension. The surface may be flat. The surface may be provided by a ring, e.g. made of plastic/cardboard.

The tubular member may include or be attached to a surface extending outwardly in a radial direction (with respect to the movement axis) from the proximal portion of the tubular member to provide a surface for attaching the tubular member to the second suspension. The surface may be flat. The surface may be provided by a ring, e.g. made of plastic/cardboard.

The wall of the tubular member could form an angle with respect to the movement axis, e.g. so that the distal portion of the tubular member is further from the movement axis than the proximal portion of the tubular member, thereby forming a frusto-conical tubular member. In this case, the angle is preferably no more than 15°.

The tubular member could have one or more extensions in radially outward direction (with respect to the movement axis) to provide a respective attachment surface for the/each suspension attached to the tubular member, thereby facilitating attachment of the/each suspension to the tubular member.

The width of the inertial exciter in the radial direction (perpendicular to the movement axis) will generally depend on design requirements.

The inertial exciter may include one or more wires configured to provide an electrical path for supplying an electrical current carrying an audio signal (representative of sound) to the voice coil.

The electrical path provided by the one or more wires may extend from a connector formed on the magnet assembly (e.g. on a frame of the magnet assembly) to the voice coil.

The one or more wires may include wire from the voice coil winding and/or a lead wire which connects to the voice coil winding.

The one or more wires may include a wire that passes through or around the tubular member. A coupling element (if present—see below) may be configured to guide said wire through or around the tubular member.

The one or more wires may include a wire that passes through or around (preferably through) a frame included in the magnet assembly.

The one or more wires may include two wires that meet at an electrical junction formed on an outwardly facing surface of the tubular member, e.g. at a solderpad or glue dot on the outwardly facing surface of the tubular member.

The magnet unit is preferably configured to provide a magnetic field in an air gap. The voice coil former and/or the tubular member may be cylindrical. But other shapes of air gap, voice coil former and tubular member are possible, e.g. oval, square.

Preferably the voice coil former is arranged around the movement axis.

The voice coil former preferably extends from the attachment portion in a direction which extends along the movement axis into the air gap.

The tubular member and voice coil former are each preferably made from lightweight materials such as paper, cardboard, Kapton, aluminium, kevlar, PE, ABS etc.

The tubular member and voice coil former are preferably made of the same material as each other, but could be made of different materials.

The tubular member and voice coil former may be formed integrally with each other (preferably also the attachment portion).

Preferably the attachment portion is arranged around the movement axis.

The attachment portion may be configured to provide an attachment between the coil assembly and the acoustic radiator by including a gluing surface configured to be glued to the acoustic radiator.

The attachment portion may be configured to provide an attachment between the coil assembly and the acoustic radiator by including bayonet features (e.g. projections) configured to engage with corresponding bayonet features (e.g. slots) on the acoustic radiator to provide a bayonet attachment between the attachment portion and the acoustic radiator.

The attachment portion may be a coupling element which is separately attached to the voice coil former and/or tubular member, e.g. by glue.

The coupling element could be a ring-shaped element, e.g. a cardboard or plastic ring.

The coupling element is not an essential element of the invention, since the attachment portion could be formed integrally with the voice coil former and/or the tubular member. Or the voice coil and tubular member could be configured to attach independently (e.g. by glue) to the acoustic radiator, in which case the attachment portion could include the glue and part of the acoustic radiator.

The/each suspension could take various forms.

Preferably, the/each suspension includes one or more corrugations. A suspension including one corrugation is preferred in some examples.

The at least one suspension may include a spider. The/each suspension may be a spider.

The at least one suspension may include a roll suspension. The/each suspension may be a roll suspension.

The at least one suspension may include a piece of sheet material having a geometry configured to allow deflection in a direction parallel to the movement axis, whilst inhibiting movement in a direction perpendicular to the movement axis. The/each suspension may be a piece of sheet material having a geometry configured to allow deflection in a direction parallel to the movement axis, whilst inhibiting movement in a direction perpendicular to the movement axis.

A potential advantage of a sheet material suspension could be a reduced height (in the movement axis direction) compared with classic suspensions which typically require a corrugation to facilitate deflection in the movement axis direction.

If there are two suspensions, each suspension including one or more corrugations, then the one or more corrugations in one suspension may mirror the one or more corrugations in the other spider, e.g. with respect to a plane perpendicular to the movement axis, e.g. to help cancel asymmetries in stiffness.

The magnet unit may include a central main magnet and a U-yoke.

In use, electrical current carrying an audio signal is supplied to the voice coil which energises the voice coil and causes a magnetic field to be produced by the current in the voice coil, which interacts with the magnetic field produced in the air gap by the magnet unit, and causes the voice coil assembly to move relative to the magnet assembly. This relative movement is accommodated by the at least one suspension.

We note for completeness that [13] teaches a loudspeaker that incorporates a tubular member similar to that shown in the loudspeaker according to the first aspect of the invention, but crucially in [13] the magnet assembly is attached to the frame (and is not suspended from the panel via the coil assembly), and therefore does not incorporate an inertial exciter. There is only one suspension connected between the tubular member and the frame in [13].

A second aspect of the invention provides:

An inertial exciter for use with an acoustic radiator, the inertial exciter comprising:

- a magnet assembly including a magnet unit configured to provide a magnetic field in an air gap, wherein the air gap extends around a movement axis of the exciter;
- a coil assembly including:
  - an attachment portion configured to provide an attachment between the coil assembly and the acoustic radiator;
  - a voice coil;
  - a voice coil former which extends from the attachment portion into the air gap, wherein the voice coil is mounted to the voice coil former so that the voice coil sits in the air gap when the inertial exciter is at rest;
  - a tubular member, which is positioned radially inwardly of the voice coil former with respect to the movement axis, and which overlaps the voice coil former along at least a portion of the movement axis;
- at least one suspension attached to the tubular member and a part of the magnet assembly positioned radially inwardly of the tubular member so that, when the coil assembly is attached to the acoustic radiator via the attachment portion, the magnet assembly is suspended from the acoustic radiator via the coil assembly by the at least one suspension.

The inertial exciter provided by the second aspect of the invention is similar to that provided by the first aspect of the invention, and provides essentially the same benefits as the inertial exciter provided by the first aspect of the invention, but with the components arranged in a different order in the radial direction with respect to the movement axis.

The inertial exciter provided by the second aspect of the invention permits use of a ring-shaped magnet, allow more magnet material to be used compared with the inner magnet type examples, and therefore enable more powerful inertial exciters, as may be desirable in some cases.

An inertial exciter according to the second aspect of the invention may thus incorporate any one or more features described in connection with an inertial exciter according to the first aspect of the invention, but with the ordering and direction of certain elements being altered in the radial direction (with respect to the movement axis) in order to provide equivalent benefits. Similarly, definitions described above with respect to the first aspect of the invention may be used in connection with the first aspect of the invention.

Some example features of an inertial exciter according to the second aspect of the invention will now be described.

The movement axis may be defined as an axis along which the voice coil assembly is configured to move relative to the magnet assembly when the inertial exciter is activated by supplying electrical current carrying an audio signal to the voice coil.

The inertial exciter may be considered to be at rest when electrical current is not supplied to the voice coil.

Note that in order for the magnet assembly to be suspended from the acoustic radiator via the coil assembly, the magnet assembly should only be attached to the acoustic radiator via the coil assembly, i.e. with no rigid attachment between the magnet assembly and the acoustic radiator.

Preferably, the inertial exciter comprises:

- a first suspension attached to the tubular member and the part of the magnet assembly positioned radially inwardly of the tubular member; and
- a second suspension, separated from the first suspension in a direction extending parallel to the movement axis, wherein the second suspension is either: attached to the tubular member and the part of the magnet assembly positioned radially inwardly of the tubular member or is attached to the voice coil former and a part of the magnet assembly positioned radially outwardly of the voice coil former.

For a typical application, the distance between locations at which the two suspensions attach to the part of the magnet assembly positioned radially inwardly of the tubular member may be at least 3 mm, more preferably at least 5 mm, more preferably at least 6 mm as measured in a direction extending parallel to the movement axis. A skilled person would appreciate that actual distances will vary in practice depending on various factors including weight of the magnet assembly (larger weight requires larger distance) and design limitations (e.g. space in aperture in which loudspeaker is to be installed).

The magnet assembly may include a frame to which the magnet unit is attached, wherein the part of the magnet assembly positioned radially inwardly of the tubular member (to which the at least one suspension is attached) is a part of the frame.

The part of the magnet assembly positioned radially inwardly of the tubular member (to which the at least one suspension is attached) could, for example, be a hub of the frame.

The part of the magnet assembly positioned radially inwardly of the tubular member (to which the at least one suspension is attached) may include a respective ledge for the/each suspension attached to the part of the magnet assembly positioned radially inwardly of the tubular member, thereby facilitating attachment of the suspension element(s) to the part of the magnet assembly positioned radially inwardly of the tubular member.

The frame (included in the magnet assembly) may include apertures configured to allow a jig to be inserted to centre the tubular member during assembly.

Some optional features of the inertial exciter described herein are described with reference to:

- a first plane perpendicular to the movement axis which extends through the attachment portion;
- a second plane perpendicular to the movement axis which extends through the air gap.

Features described with reference to the first and second planes are preferably described with respect to the inertial exciter when the inertial exciter is at rest. As noted above, the inertial exciter may be considered to be at rest when electrical current is not supplied to the voice coil.

The part of the magnet assembly positioned radially inwardly of the tubular member (to which the at least one suspension is attached) may include:

- a proximal portion, wherein the proximal portion of the part of the magnet assembly positioned radially inwardly of the tubular member is located between the first plane and the second plane; and a distal portion, wherein the distal portion of the part of the magnet unit positioned radially inwardly of the tubular member is located is on an opposite side of the second plane from the proximal portion (of the part of the magnet assembly positioned radially inwardly of the tubular member).

The magnet assembly may include a part of the magnet assembly positioned radially outwardly of the voice coil former, wherein the part of the magnet assembly position radially outwardly of the voice coil former includes:

a proximal portion, wherein the proximal portion of the part of the magnet assembly positioned radially outwardly of the voice coil former is located between the first plane and the second plane; and a distal portion, wherein the distal portion of the part of the magnet unit positioned radially outwardly of the voice coil former is located is on an opposite side of the second plane from the proximal portion (of the part of the magnet assembly positioned radially outwardly of the voice coil former).

The part of the magnet assembly positioned radially outwardly of the voice coil former may include part of the magnet unit. The proximal portion of the part of the magnet assembly positioned radially outwardly of the voice coil former may for example include part of the magnet unit, e.g. a washer 213*a* as shown in FIG. 5(*a*). The distal portion of the part of the magnet assembly positioned radially outwardly of the voice coil former may for example include part of the magnet unit, e.g. a main magnet 212*a* as shown in FIG. 5(*a*).

The tubular member may include:

a proximal portion, wherein the proximal portion of the tubular member is located between the first plane and the second plane;

a distal portion, wherein the distal portion of the tubular member is located is on an opposite side of the second plane from the proximal portion (of the tubular member).

The voice coil former may include:

a proximal portion, wherein the proximal portion of the voice coil former is located between the first plane and the second plane;

a distal portion, wherein the distal portion of the voice coil former is located is on an opposite side of the second plane from the proximal portion (of the voice coil former).

Note that if the tubular member has the distal portion (as described above), this allows the tubular member to reach past the air gap on the inside of the magnet unit, and allows the first and second suspensions to be separated by a larger distance, compared with an arrangement in which the two suspensions are attached to the voice coil former.

Preferably, the first suspension is attached to the distal portion of the tubular member and the distal portion of the part of the magnet assembly positioned radially inwardly of the tubular member.

Preferably, the second suspension is attached to the proximal portion of the tubular member and the proximal portion of the part of the magnet assembly positioned radially inwardly of the tubular member.

However, the second suspension could potentially instead attach to the proximal portion of the voice coil former and the proximal portion of the part of the magnet assembly positioned radially outwardly of the voice coil former (e.g. as shown in FIG. 5(*c*)), whilst still allowing a wide separation between the first and second suspensions, thereby still helping to reduce the rotation discussed above with reference to FIG. 2(*c*).

Preferably, the inertial exciter comprises both:

a first suspension that is attached to the distal portion of the tubular member and the distal portion of the part of the magnet assembly positioned radially inwardly of the tubular member; and a second suspension that is attached to the proximal portion of the tubular member and the proximal portion of the part of the magnet assembly positioned radially inwardly of the tubular member.

This arrangement allows the first and second suspensions to have a particularly large space between them, which helps to reduce the rotation discussed above with reference to FIG. 2(*c*).

In this arrangement, the inertial exciter may optionally include a third suspension that is attached to the proximal portion of the voice coil former and the proximal portion of the part of the magnet assembly positioned radially outwardly of the voice coil former (e.g. as shown in FIG. 5(*b*)).

The magnet unit preferably extends around the tubular member.

The tubular member preferably overlaps the magnet unit along at least a portion of the movement axis.

The tubular member may be shaped to include the attachment portion, e.g. so as to facilitate direct gluing (or some other attachment) of the tubular member to the acoustic radiator.

The tubular member may be shaped to include the attachment portion and the voice coil former.

The tubular member may include or be attached to a surface extending inwardly in a radial direction (with respect to the movement axis) from the distal portion of the tubular member to provide a surface for attaching the tubular member to the first suspension. The surface may be flat. The surface may be provided by a ring, e.g. made of plastic/cardboard.

The tubular member may include or be attached to a surface extending inwardly in a radial direction (with respect to the movement axis) from the proximal portion of the tubular member to provide a surface for attaching the tubular member to the second suspension. The surface may be flat. The surface may be provided by a ring, e.g. made of plastic/cardboard.

The wall of the tubular member could form an angle with respect to the movement axis, e.g. so that the distal portion of the tubular member is closer to the movement axis that the proximal portion of the tubular member, thereby forming a frusto-conical tubular member. In this case, the angle is preferably no more than 15°.

The tubular member could have one or more extensions in radially inward direction (with respect to the movement axis) to provide a respective attachment surface for the/each suspension attached to the tubular member, thereby facilitating attachment of the/each suspension to the tubular member.

The width of the inertial exciter in the radial direction (perpendicular to the movement axis) will generally depend on design requirements.

The inertial exciter may include one or more wires configured to provide an electrical path for supplying an electrical current carrying an audio signal (representative of sound) to the voice coil.

The electrical path provided by the one or more wires may extend from a connector formed on the magnet assembly (e.g. on a frame of the magnet assembly) to the voice coil.

The one or more wires may include wire from the voice coil winding and/or a lead wire which connects to the voice coil winding.

The one or more wires may include a wire that passes through or around the tubular member. A coupling element (if present—see below) may be configured to guide said wire through or around the tubular member.

The one or more wires may include a wire that passes through or around (preferably through) a frame included in the magnet assembly.

The one or more wires may include two wires that meet at an electrical junction formed on an inwardly facing surface of the tubular member, e.g. at a solderpad or glue dot on the inwardly facing surface of the tubular member.

The magnet unit is preferably configured to provide a magnetic field in an air gap. The voice coil former and/or the tubular member may be cylindrical. But other shapes of air gap, voice coil former and tubular member are possible, e.g. oval, square.

Preferably the voice coil former is arranged around the movement axis.

The voice coil former preferably extends from the attachment portion in a direction which extends along the movement axis into the air gap.

The tubular member and voice coil former are each preferably made from lightweight materials such as paper, cardboard, Kapton, aluminium, kevlar, PE, ABS etc.

The tubular member and voice coil former are preferably made of the same material as each other, but could be made of different materials.

The tubular member and voice coil former may be formed integrally with each other (preferably also the attachment portion).

Preferably the attachment portion is arranged around the movement axis.

The attachment portion may be configured to provide an attachment between the coil assembly and the acoustic radiator by including a gluing surface configured to be glued to the acoustic radiator.

The attachment portion may be configured to provide an attachment between the coil assembly and the acoustic radiator by including bayonet features configured to engage with corresponding bayonet features on the acoustic radiator to provide a bayonet attachment between the attachment portion and the acoustic radiator.

The attachment portion may be a coupling element which is separately attached to the voice coil former and/or tubular member, e.g. by glue.

The coupling element could be a ring-shaped element, e.g. a cardboard or plastic ring.

The coupling element is not an essential element of the invention, since the attachment portion could be formed integrally with the voice coil former and/or the tubular member. Or the voice coil and tubular member could be configured to attach independently (e.g. by glue) to the acoustic radiator, in which case the attachment portion could include the glue and part of the acoustic radiator.

The/each suspension could take various forms.

Preferably, the/each suspension includes one or more corrugations. A suspension including one corrugation, e.g. a roll suspension, is preferred in some examples.

The at least one suspension may include a spider. The/each suspension may be a spider.

The at least one suspension may include a roll suspension. The/each suspension may be a roll suspension.

The at least one suspension may include a piece of sheet material having a geometry configured to allow deflection in a direction parallel to the movement axis, whilst inhibiting movement in a direction perpendicular to the movement axis. The/each suspension may be a piece of sheet material having a geometry configured to allow deflection in a direction parallel to the movement axis, whilst inhibiting movement in a direction perpendicular to the movement axis.

A potential advantage of a sheet material suspension could be a reduced height (in the movement axis direction) compared with classic suspensions which typically require a corrugation to facilitate deflection in the movement axis direction.

If there are two suspensions, each suspension including one or more corrugations, then the one or more corrugations in one suspension may mirror the one or more corrugations in the other spider, e.g. with respect to a plane perpendicular to the movement axis, e.g. to help cancel asymmetries in stiffness.

The magnet unit may include a ring-shaped main magnet and a T-yoke.

In use, electrical current carrying an audio signal is supplied to the voice coil which energises the voice coil and causes a magnetic field to be produced by the current in the voice coil, which interacts with the magnetic field produced in the air gap by the magnet unit, and causes the voice coil assembly to move relative to the magnet assembly. This relative movement is accommodated by the at least one suspension.

A third aspect of the invention provides:

A loudspeaker including:

an acoustic radiator;

an inertial exciter according to the first or second aspect of the invention, wherein the coil assembly of the inertial exciter is attached to the acoustic radiator via the attachment portion so that the magnet assembly is suspended from the acoustic radiator via the coil assembly via the at least one suspension.

The acoustic radiator could have various shapes (e.g. flat, curved, small, large, geometric, free-form).

The acoustic radiator may be suspended from a frame.

The loudspeaker is preferably a dipole loudspeaker, wherein the acoustic radiator is suspended from a frame (of the dipole loudspeaker) via one or more suspension elements, wherein the frame is configured to allow sound produced by a first radiating surface of the acoustic radiator to propagate out from a first side of the dipole loudspeaker and to allow sound produced by a second radiating surface of the acoustic radiator to propagate out from a second side of the dipole loudspeaker.

Here, the first radiating surface and the second radiating surface should be located on opposite faces of the acoustic radiator.

The coil assembly of the inertial exciter may be attached to the second radiating surface of the acoustic radiator (via the attachment portion).

An inertial exciter according to the first or second aspect of the invention is particularly well suited for use in a dipole loudspeaker because its construction is such that it can obstruct a smaller area of the radiating surface of the acoustic radiator to which it is attached compared with some of the prior art examples discussed above (see e.g. [13], which requires a frame).

A fourth aspect of the invention provides:

A method of manufacturing a loudspeaker according to the third aspect of the invention.

The method may include pre-assembling the coil assembly, before suspending the magnet assembly from the coil assembly by the at least one suspension.

A fifth aspect of the invention provides:

A drive unit for use with an acoustic radiator, the drive unit comprising:

a magnet assembly including a magnet unit configured to provide a magnetic field in an air gap, wherein the air gap extends around a movement axis of the inertial exciter;

a coil assembly including:

an attachment portion configured to provide an attachment between the coil assembly and the acoustic radiator;

a voice coil;

a voice coil former which extends from the attachment portion into the air gap, wherein the voice coil is mounted to the voice coil former so that the voice coil sits in the air gap when the drive unit is at rest;

a tubular member, which is positioned radially outwardly of the voice coil former with respect to the movement axis, and which overlaps the voice coil former along at least a portion of the movement axis;

at least one suspension attached to the tubular member and a part of the magnet assembly positioned radially outwardly of the tubular member so that, when the coil assembly is attached to the acoustic radiator via the attachment portion, the acoustic radiator is suspended from the magnet assembly via the coil assembly by the at least one suspension.

The drive unit according to the fifth aspect of the invention therefore has essentially the same construction as the inertial exciter according to the first aspect of the invention, except that in the drive unit according to the fifth aspect of the invention, the acoustic radiator is suspended from the magnet assembly, rather than magnet assembly being suspended from the acoustic radiator.

This is advantageous because it helps to provide stable pistonic movement of the acoustic radiator and reduces rocking of the acoustic radiator when the magnet assembly is rigidly attached to an external body (e.g. frame), i.e. when the drive assembly is "grounded".

Preferably, the magnet assembly is rigidly attached to a frame, which may be rigidly attached to an external body.

Preferably, the magnet assembly is rigidly attached to a frame from which the acoustic radiator is suspended.

Any feature described in connection with the inertial exciter according to the first aspect of the invention may be incorporated in the drive unit according to the fifth aspect of the invention, except where such a combination is clearly impermissible or expressly avoided.

A sixth aspect of the invention provides:

A drive unit for use with an acoustic radiator, the drive unit comprising:

a magnet assembly including a magnet unit configured to provide a magnetic field in an air gap, wherein the air gap extends around a movement axis of the exciter;

a coil assembly including:

an attachment portion configured to provide an attachment between the coil assembly and the acoustic radiator;

a voice coil;

a voice coil former which extends from the attachment portion into the air gap, wherein the voice coil is mounted to the voice coil former so that the voice coil sits in the air gap when the drive unit is at rest;

a tubular member, which is positioned radially inwardly of the voice coil former with respect to the movement axis, and which overlaps the voice coil former along at least a portion of the movement axis;

at least one suspension attached to the tubular member and a part of the magnet assembly positioned radially inwardly of the tubular member so that, when the coil assembly is attached to the acoustic radiator via the attachment portion, the acoustic radiator is suspended from the magnet assembly via the coil assembly by the at least one suspension.

The drive unit according to the sixth aspect of the invention therefore has essentially the same construction as the inertial exciter according to the second aspect of the invention, except that in the drive unit according to the sixth aspect of the invention, the acoustic radiator is suspended from the magnet assembly, rather than magnet assembly being suspended from the acoustic radiator.

This is advantageous because it helps to provide stable pistonic movement of the acoustic radiator and reduces rocking of the acoustic radiator when the magnet assembly is rigidly attached to an external body (e.g. frame), i.e. when the drive assembly is "grounded".

Preferably, the magnet assembly is rigidly attached to a frame, which may be rigidly attached to an external body.

Preferably, the magnet assembly is rigidly attached to a frame from which the acoustic radiator is suspended.

Any feature described in connection with the inertial exciter according to the first aspect of the invention may be incorporated in the drive unit according to the fifth aspect of the invention, except where such a combination is clearly impermissible or expressly avoided.

A seventh aspect of the invention provides:

A loudspeaker including:

an acoustic radiator;

a drive unit according to the fifth or sixth aspect of the invention, wherein the coil assembly of the drive unit is attached to the acoustic radiator via the attachment portion so that the acoustic radiator is suspended from the magnet assembly via the coil assembly by the at least one suspension.

The acoustic radiator could have various shapes (e.g. flat, curved, small, large, geometric, free-form).

The acoustic radiator may be suspended from a frame.

The loudspeaker is preferably a dipole loudspeaker, wherein the acoustic radiator is suspended from a frame (of the dipole loudspeaker) via one or more suspension elements, wherein the frame is configured to allow sound produced by a first radiating surface of the acoustic radiator to propagate out from a first side of the dipole loudspeaker and to allow sound produced by a second radiating surface of the acoustic radiator to propagate out from a second side of the dipole loudspeaker.

Here, the first radiating surface and the second radiating surface should be located on opposite faces of the acoustic radiator.

The coil assembly of the inertial exciter may be attached to the second radiating surface of the acoustic radiator (via the attachment portion).

Preferably, the magnet assembly is rigidly attached to the frame from which the acoustic radiator is suspended.

A drive unit according to the fifth or sixth aspect of the invention is particularly well suited for use in a dipole loudspeaker because its construction is such that it can obstruct a smaller area of the radiating surface of the acoustic radiator to which it is attached compared with some of the prior art examples discussed above (see e.g. [13], which requires a frame).

An eighth aspect of the invention provides:

A method of manufacturing a loudspeaker according to the third aspect of the invention.

The method may include pre-assembling the coil assembly, before suspending the magnet assembly from the coil assembly by the at least one suspension.

The invention includes the combination of the aspects and preferred features described except where such a combination is clearly impermissible or expressly avoided.

SUMMARY OF THE FIGURES

Embodiments and experiments illustrating the principles of the invention will now be discussed with reference to the accompanying figures in which:

FIG. 1(*b*) shows an example inertial exciter.

FIG. 2(*b*) is a graph showing force level vs frequency for the loudspeaker shown in FIG. 2(*a*).

FIG. 2(*c*) illustrates a problem with the inertial exciter shown in FIG. 2(*a*).

FIG. 3(*a*)(*i*) and (ii) illustrate "Solution A" as taught by the prior art.

FIG. 3(*b*)(*i*) and (ii) illustrate "Solution B" as taught by the prior art.

FIG. 3(*c*)(*i*) and (ii) illustrate "Solution C" as taught by the prior art.

FIG. 3(*d*)(*i*) and (ii) illustrate "Solution D" as taught by the prior art.

FIG. 3(*e*)(*i*) and (ii) illustrate "Solution E" as taught by the prior art.

FIG. 3(*f*)(*i*) and (ii) illustrate "Solution F" as taught by the prior art.

FIG. 4(*b*)(*i*)-(iv) show a second inertial exciter 101*b* that exemplifies an inertial exciter of the inner magnet type, and a loudspeaker 180*b* incorporating the first initial exciter 101*b*.

FIG. 4(*c*) shows a third inertial exciter 101*c* that exemplifies an inertial exciter of the inner magnet type.

FIG. 4(*d*) shows a fourth inertial exciter 101*d* that exemplifies an inertial exciter of the inner magnet type.

FIG. 4(*e*) shows a fifth inertial exciter 101*e* that exemplifies an inertial exciter of the inner magnet type.

FIG. 4(*f*) shows a sixth inertial exciter 101*f* that exemplifies an inertial exciter of the inner magnet type.

FIG. 4(*g*) shows a seventh inertial exciter 101*g* that exemplifies an inertial exciter of the inner magnet type.

FIG. 4(*h*) shows an eighth inertial exciter 101*h* that exemplifies an inertial exciter of the inner magnet type.

FIG. 4(*i*)(*i*)-(viii) shows a ninth inertial exciter 101*i* that exemplifies an inertial exciter of the inner magnet type.

FIG. 4(*j*)(*i*)-(ii) show a tenth inertial exciter 101*j* that exemplifies an inertial exciter of the inner magnet type.

FIG. 4(*k*) shows an eleventh inertial exciter 101*k* that exemplifies an inertial exciter of the inner magnet type.

FIG. 4(*l*) shows a twelfth inertial exciter 101*l* that exemplifies an inertial exciter of the inner magnet type.

FIG. 5(*b*) shows a second inertial exciter 201*b* that exemplifies an inertial exciter of the outer magnet type.

FIG. 5(*c*) shows a third inertial exciter 201*c* that exemplifies an inertial exciter of the outer magnet type.

FIG. 5(*d*) shows a fourth inertial exciter 201*d* that exemplifies an inertial exciter of the outer magnet type.

FIG. 6(*b*) shows a drive unit that exemplifies a drive unit of the outer magnet type.

DETAILED DESCRIPTION OF THE INVENTION

Figure 1A:
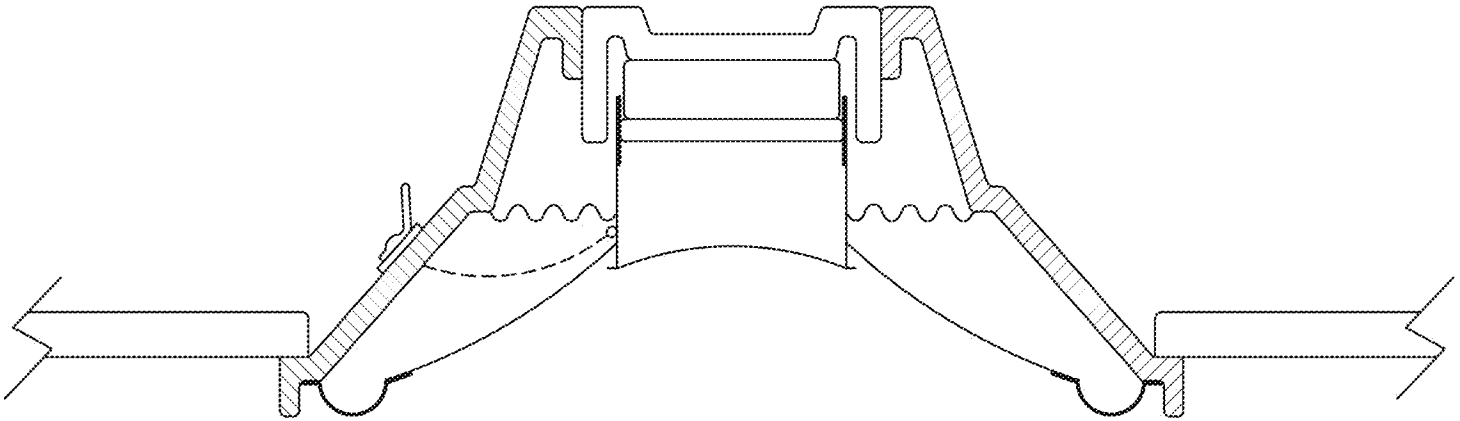
FIG. 1A (PRIOR ART)
FIG. 1(*a*) shows an example traditional loudspeaker.
Figure 1B:
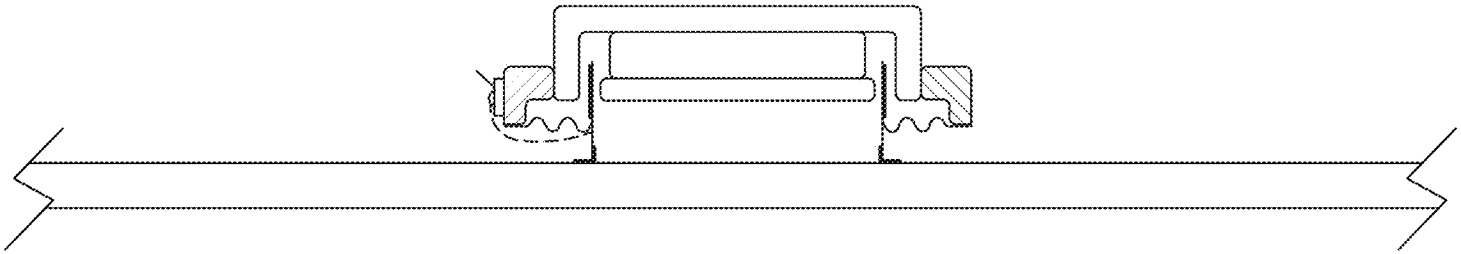
FIG. 1B (PRIOR ART)
Figure 2A:
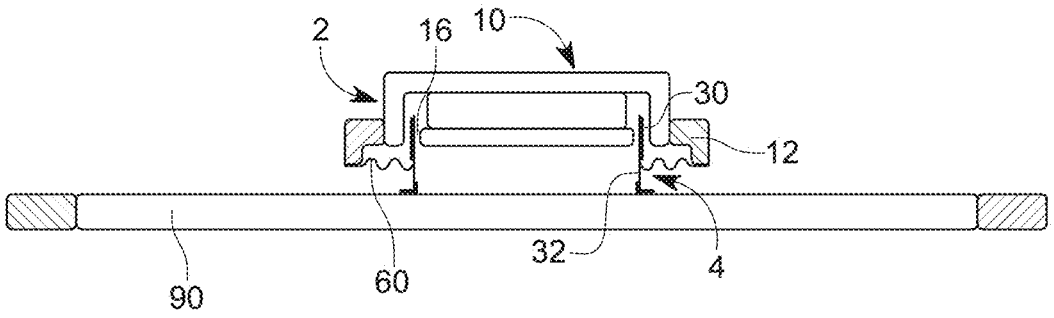
FIG. 2A (PRIOR ART)
FIG. 2(*a*) shows a loudspeaker incorporating a wide bandwidth inertial exciter implementing principles derived from the prior art.
Figure 2B:
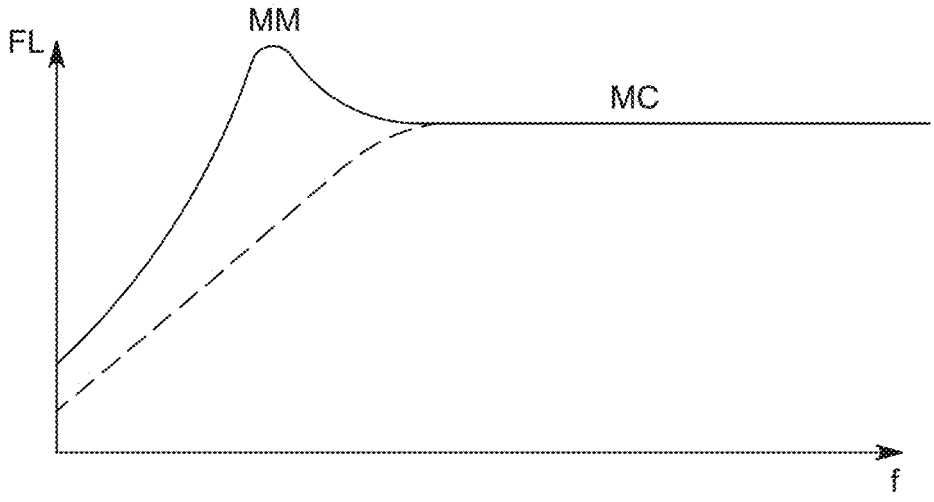
FIG. 2B (PRIOR ART)
Figure 2C:
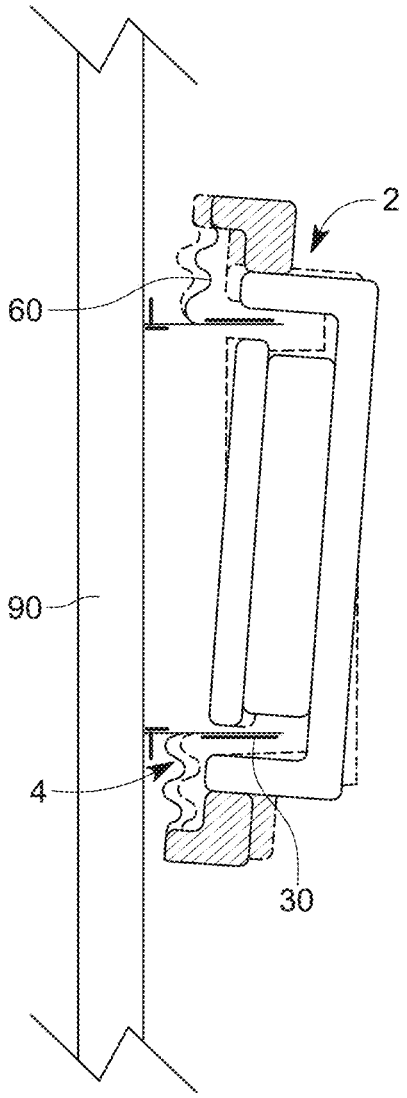
FIG. 2C (PRIOR ART)
Figure 4C:
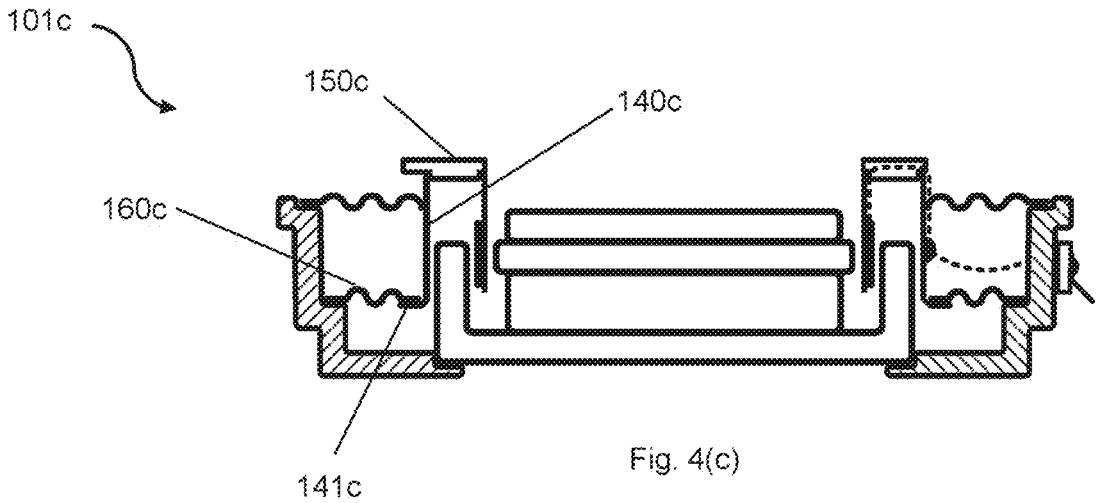
FIG. 4(*a*)(*i*)-(vi) show a first inertial exciter 101*a* that exemplifies an inertial exciter of the inner magnet type, and a loudspeaker 180*a* incorporating the first initial exciter 101*a*.
Figure 4D:
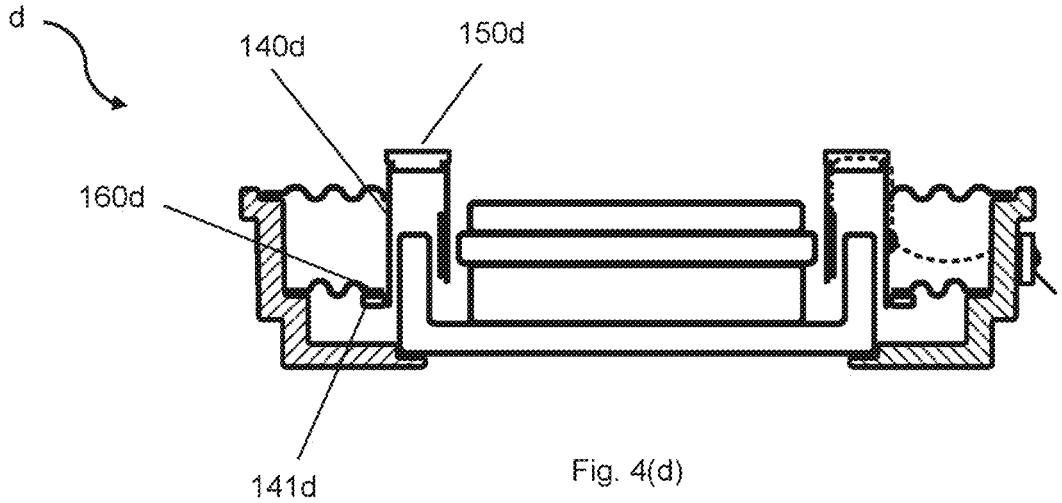
Figure 4E:
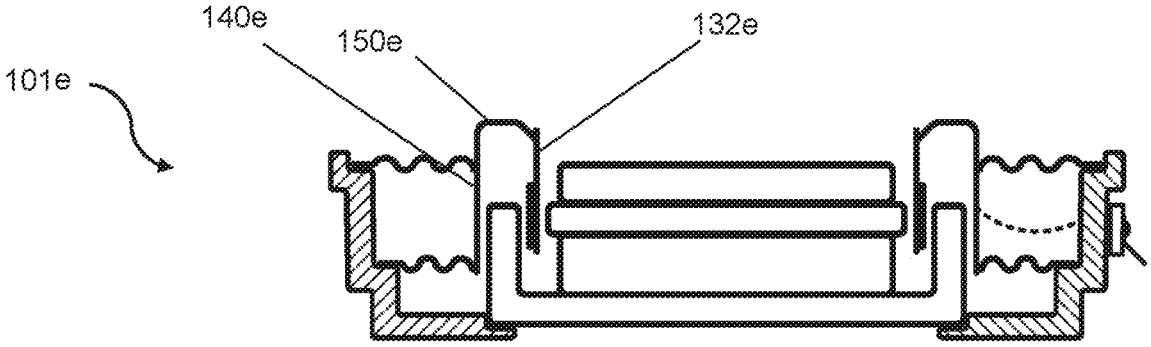
Figure 4F:
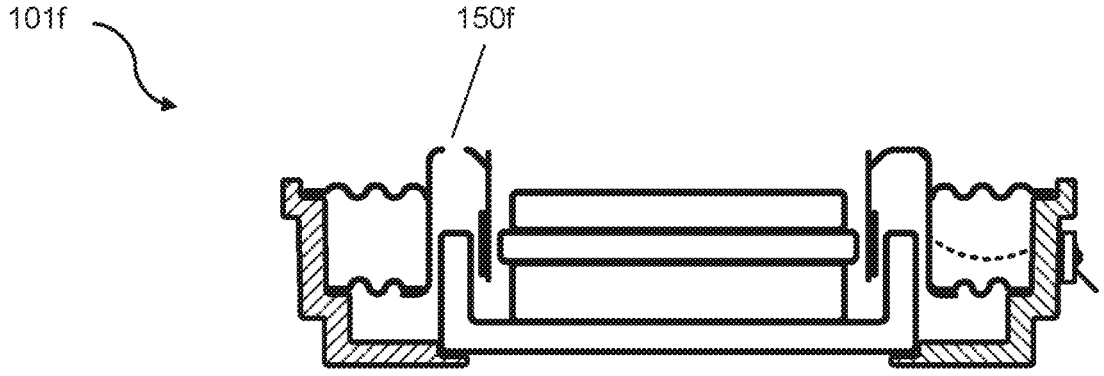
Figure 4G:
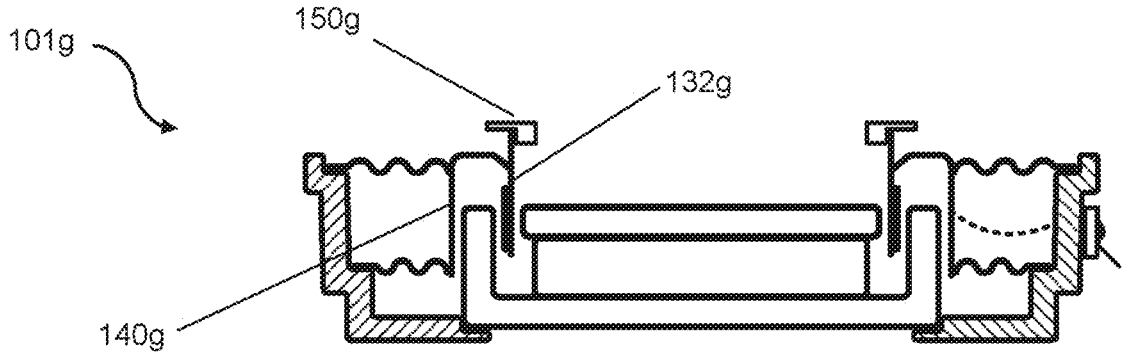
Figure 4H:
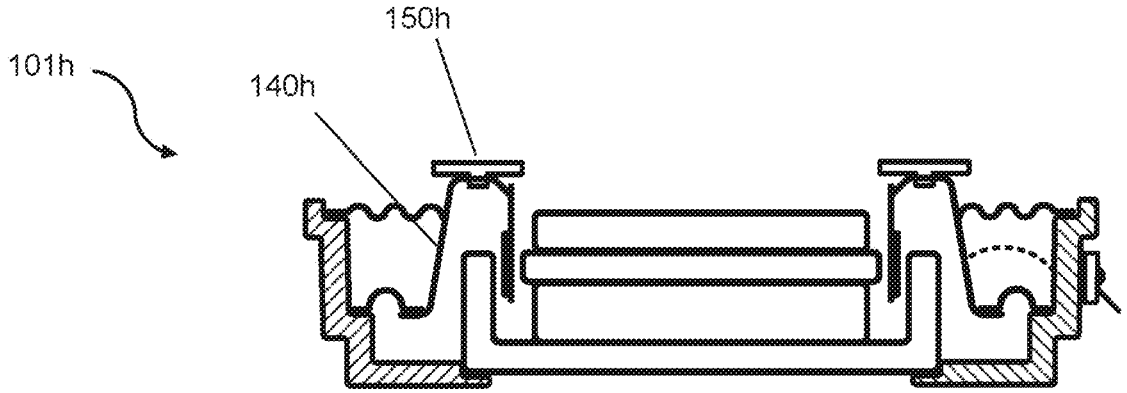
Figure 4K:
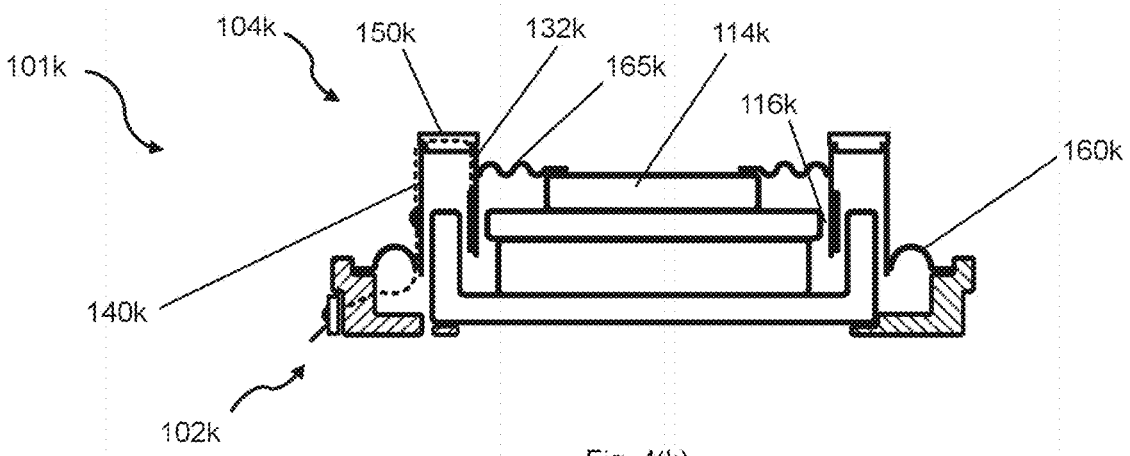
Figure 4L:
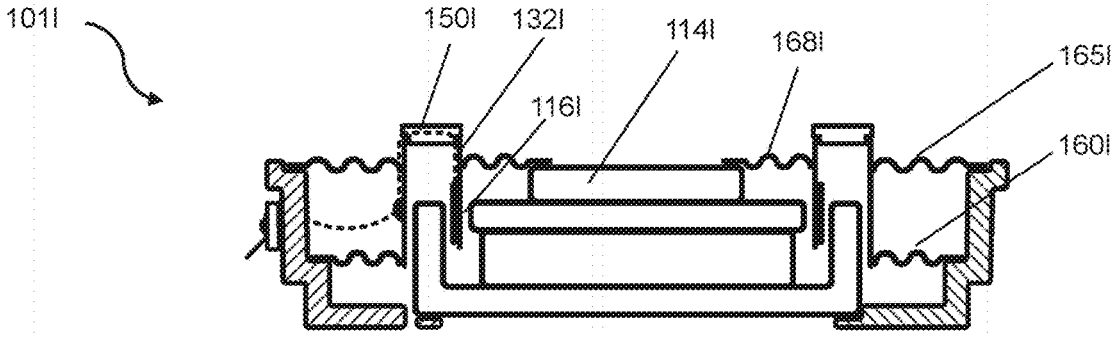
Figure 5A:
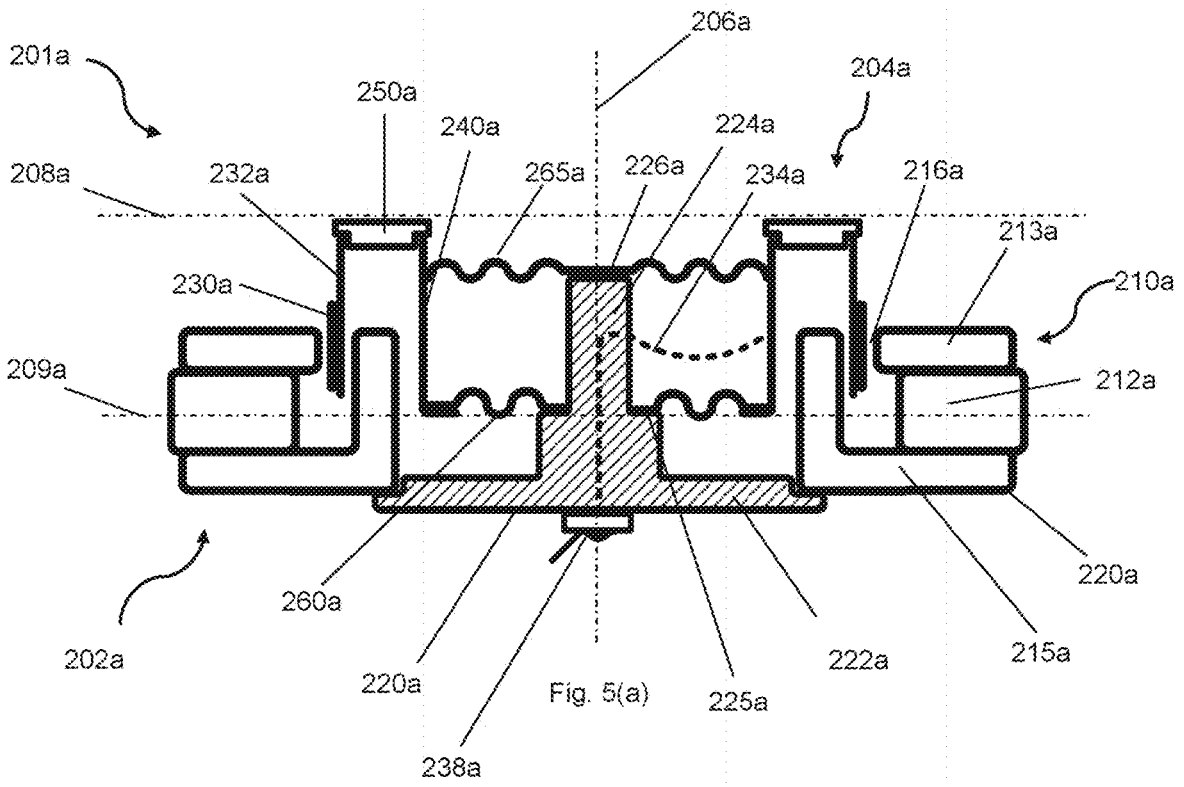
FIG. 5(*a*) shows a first inertial exciter 201*a* that exemplifies an inertial exciter of the outer magnet type.
Figure 5B:
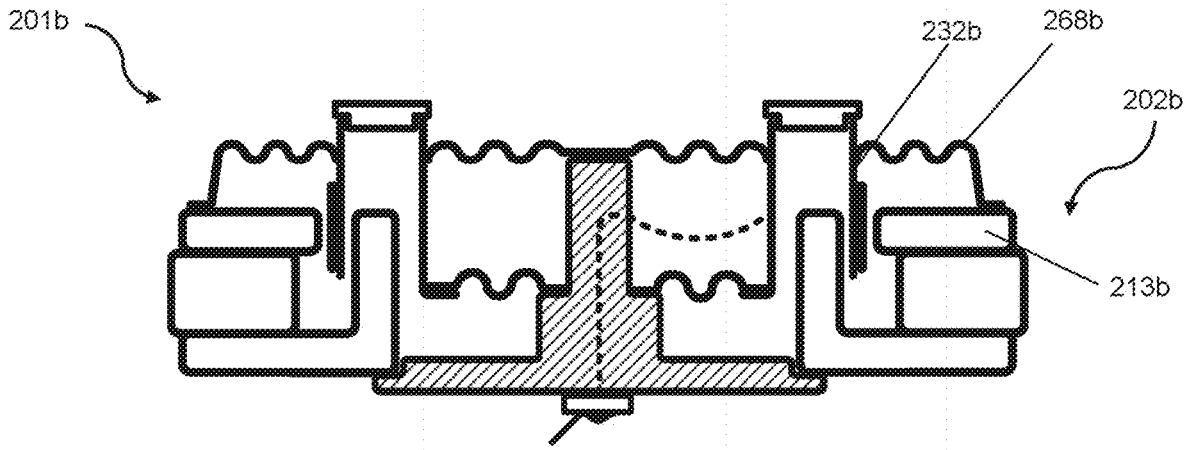
Figure 5C:
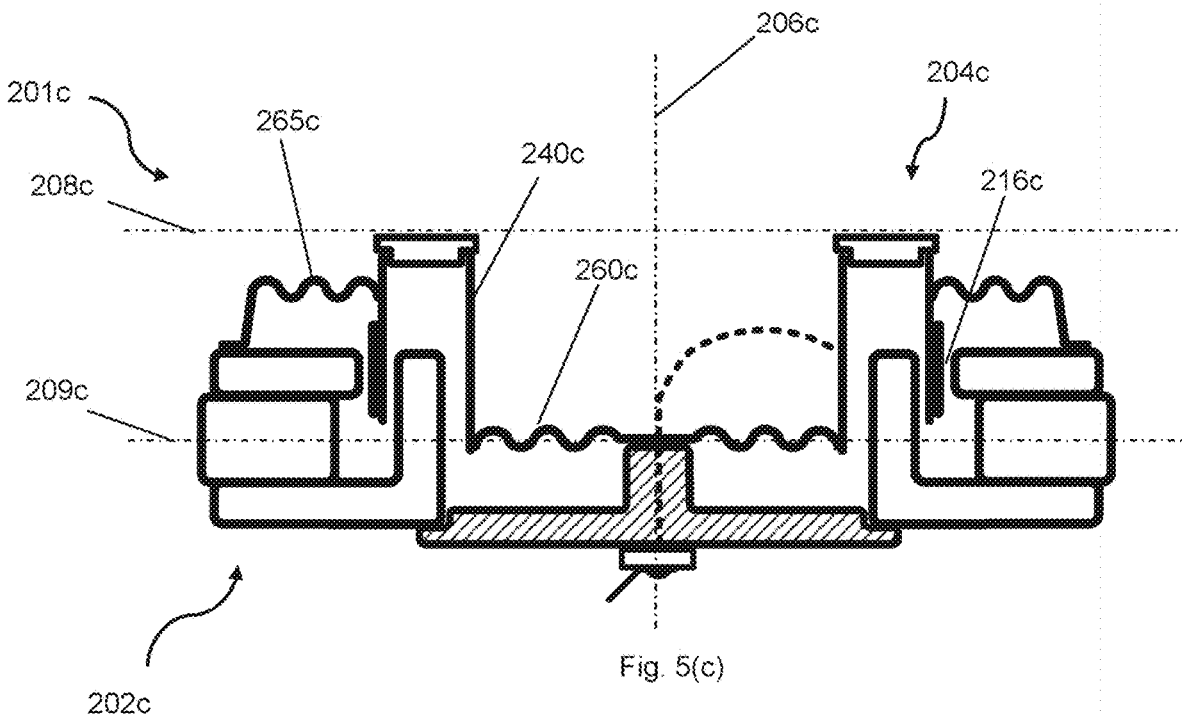
Figure 5D:
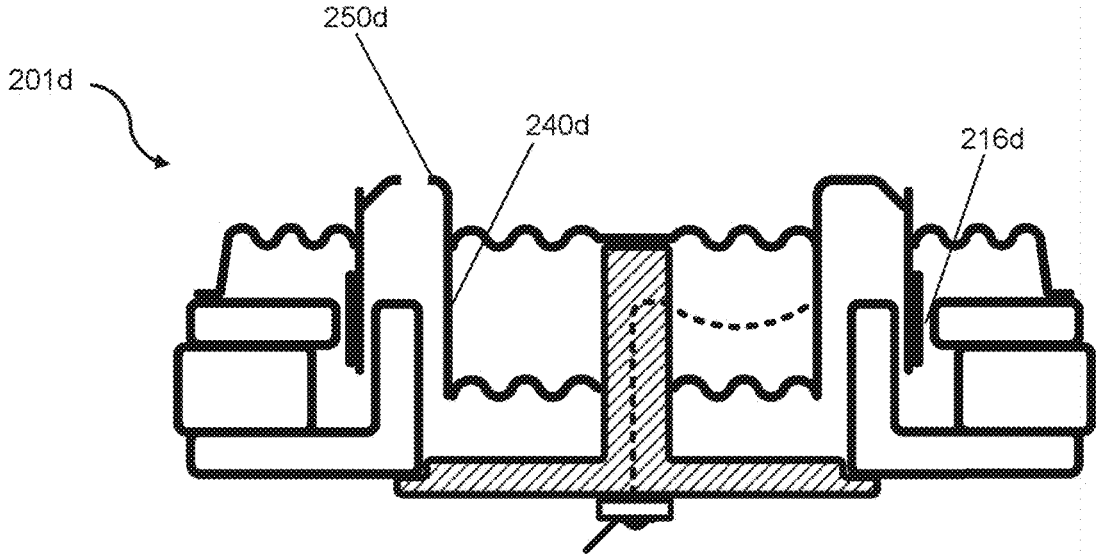

Aspects and embodiments of the present invention will now be discussed with reference to the accompanying figures. Further aspects and embodiments will be apparent to those skilled in the art. All documents mentioned in this text are incorporated herein by reference.

For the purpose of this description, example inertial exciters are divided into two types, referred to as "inner magnet" type according to the first aspect of the invention and "outer magnet" type according to the second aspect of the invention. Similarly, example drive units are divided into two types, referred to as "inner magnet" type according to the fifth aspect of the invention and "outer magnet" type according to the sixth aspect of the invention

Inertial Exciter—Inner Magnet Type Examples

A first inertial exciter 101*a* that exemplifies an inertial exciter of the inner magnet type is shown in FIG. 4(*a*)(*i*).

The inertial exciter 101*a* of FIG. 4(*a*) comprises a magnet assembly 102*a* and a coil assembly 104*a*.

The magnet assembly 102*a* includes a magnet unit 110*a* and a frame 120*a* to which the magnet unit 110*a* is attached.

In this example, the magnet unit 110*a* includes a main magnet 112*a*, a washer 113*a* an extra magnet 114*a* and a U-yoke 115*a*. The magnet unit 110*a* is configured to provide a magnetic field in an air gap 116*a*. The air gap 116*a* extends around a movement axis 106*a* of the inertial exciter 101*a*.

The frame 120*a* includes a base portion 122*a* which extends radially outwardly with respect to the movement axis 106*a* (in this example from a base of the U-yoke 115*a*), and a rim 124*a* which extends axially with respect to the movement axis 106*a*, that is at least partly along the movement axis 106*a*. The rim 124*a* of the frame 120*a* is positioned at the periphery of the base portion 122*a*, and is positioned radially outwardly of the magnet unit 110*a*.

The rim 124*a* of the frame 120*a* is positioned radially outwardly of a tubular member 140*a*, and thus serves as the "part of the magnet assembly positioned radially outwardly of the tubular member" referenced in the "Summary of the invention" section of this document, above.

In this example, the main magnet 112*a*, washer 113*a*, extra magnet 114*a*, U-yoke 115*a*, and air gap 116*a* are circular, though other forms are possible.

In this example, the washer 114*a* and U-yoke 116*a* may be made of steel, though other materials are possible.

In this example, the coil assembly 104*a* includes a voice coil 130*a*, a voice coil former 132*a*, a tubular member 140*a* and an attachment portion 150*a*.

In this example, the attachment portion 150*a* is a coupling element which is separately attached to the voice coil former and tubular member, e.g. by glue. The coupling element

150*a* is configured to provide an attachment between the coil assembly 104*a* and an acoustic radiator (not shown) by including a gluing surface 151*a* configured to be glued to the acoustic radiator. The coupling element 150*a* could for example be a plastic or cardboard ring-shaped element.

The voice coil former 132*a* extends axially with respect to the movement axis 106*a* from the coupling element 150*a* into the air gap 116*a*. The voice coil 130*a* is mounted to the voice coil former 132*a* so that the voice coil 130*a* sits in the air gap 116*a* when the inertial exciter 101*a* is at rest.

The tubular member 140*a* is positioned radially outwardly of the voice coil former 132*a* with respect to the movement axis 106*a*. The tubular member 140*a* also overlaps the voice coil former 132*a* along a portion of the movement axis (this portion corresponding to the full length of the voice coil former 132*a*).

In this example, the voice coil former 132*a* and tubular member 140*a* are cylindrical, though other shapes are possible.

Two planes are depicted in FIG. 4(*a*)(*i*).

A first plane 108*a* is perpendicular to the movement axis 106*a* and extends through the attachment portion which as noted above is the coupling element 150*a*.

A second plane 109*a* is perpendicular to the movement axis 106*a* and extends through the air gap 116*a*.

The rim 124*a* of the frame 120*a* includes:

- a proximal portion, wherein the proximal portion of the rim 124*a* is located between the first plane 108*a* and the second plane 109*a;* and
- a distal portion, wherein the distal portion of the rim 124*a* is located is on an opposite side of the second plane 109*a* from the proximal portion of the rim 124*a*.

The tubular member 140*a* similarly includes:

- a proximal portion, wherein the proximal portion of the tubular member 140*a* is located between the first plane 108*a* and the second plane 109*a;* and
- a distal portion, wherein the distal portion of the tubular member 140*a* is located is on an opposite side of the second plane 109*a* from the proximal portion of the of the tubular member 140*a*.

The inertial exciter 101*a* includes:

- a first suspension 160*a* that is attached to the distal portion of the tubular member 140*a* and the distal portion of the rim 124*a;* and
- a second suspension 165*a* that is attached to the proximal portion of the tubular member 140*a* and the proximal portion of the rim 124*a*.

Each suspension 160*a*, 165*a* in this example is a spider including multiple corrugations. Such suspensions are well known in the art.

Thus, when the coil assembly 104*a* is attached to the acoustic radiator via the attachment portion/coupling element 150*a*, the magnet assembly 102*a* is suspended from the acoustic radiator via the coil assembly 104*a* by the first and second suspensions 160*a*, 165*a*.

As can be seen from FIG. 4(*a*)(*i*), the rim 124*a* of the frame 120*a* includes a first ledge 125*a* to which the first suspension 160*a* is attached, and a second ledge 126*a* to which the second suspension 165*a* is attached.

In this example, the first and second suspensions 160*a*, 165*a* are each shown as a respective spider having multiple corrugations.

The inertial exciter 101*a* includes wires 134*a*, 135*a* configured to provide an electrical path for supplying an electrical current carrying an audio signal (representative of sound) to the voice coil 130*a*.

The electrical path provided by the wires 134*a*, 135*a* extend from a connector 138*a* formed on an outwardly facing surface of the rim 124*a* of the frame 120*a* to the voice coil 130*a*.

In this example, the wires include part of the voice coil winding 134*a* as well as a lead wire 135*a*. In this example, the voice coil winding 134*a* extends around the tubular member 140*a* as guided by the coupling element 150*a*.

The voice coil winding 134*a* and lead wire 135*a* meet at an electrical junction formed at a solderpad or glue dot 136*a* on an outwardly facing surface of the tubular member 140*a*.

FIG. 4(*a*)(*ii*) shows a loudspeaker 180*a* including the inertial exciter 101*a* of FIG. 4(*a*)(*i*) and an acoustic radiator 190*a* suspended from a frame 192, wherein the coil assembly 104*a* of the inertial exciter 101*a* is attached to the acoustic radiator 190*a* via the attachment portion/coupling element 150*a* so that the magnet assembly 102*a* is suspended from the acoustic radiator 190*a* via the coil assembly by the first and second suspensions 160*a*, 165*a*.

In use, electrical current carrying an audio signal is supplied to the voice coil 130*a* via the connector 138*a* and wires 134*a*, 135*a*. This energises the voice coil 130*a* and causes a magnetic field to be produced by the current in the voice coil 130*a*, which interacts with the magnetic field produced in the air gap 116*a* by the magnet unit 110*a*, and causes the voice coil assembly 104*a* to move relative to the magnet assembly 102*a*. This relative movement is accommodated by the first and second suspensions 160*a*, 165*a*.

Because the magnet assembly 102*a* is suspended from the acoustic radiator via the coil assembly 104*a* by the first and second suspensions 160*a*, 165*a*, the loudspeaker is able to be moved by MC and MM excitation, as indicated by FIG. 4(*a*)(*iii*).

Because the voice coil former 132*a* and tubular member 140*a* are tubular, they provide good stiffness even when made of a lightweight material such as paper, cardboard, Kapton, aluminium, kevlar etc. Thus, the voice coil assembly 104*a* can have low weight and good stiffness, as is needed for good wide bandwidth performance from MC excitation.

Moreover, because the tubular member 140*a* has a distal portion which overlaps the voice coil former 132*a* so as to extend beyond the air gap 116*a*, i.e. to the opposite side of the second plane 109*a* from the proximal portion of the tubular member 140*a*, it is possible to have a large distance between the first and second suspensions 160*a*, 165*a*, which helps inhibit rotation of the magnet assembly 102*a* relative to the voice coil assembly 104*a* when the acoustic radiator 190*a* is vertically mounted, e.g. as may be the case in a car door, as depicted in FIG. 4(*a*)(*iii*).

Note that this is achieved whilst providing one interface (the glue surface of the coupling element 150*a*) with the acoustic radiator 190*a*, and also whilst permitting MC excitation. The low mass of the voice coil assembly (see above) help to achieve acoustic sensitivity and balance in the upper frequency band, as depicted in FIG. 4(*a*)(*iv*).

FIG. 4(*a*)(*v*) shows a method step involved in assembling the inertial exciter 101*a* which makes use of a conventional centering jig 195*a* to align the voice coil former 132*a* in the air gap 116*a* before the components of the voice coil assembly 104*a* are glued together. The coupling element 150*a* may be flush with an inwardly facing surface of the voice coil former 132*a* to facilitate use of the centering jig 195*a*.

FIG. 4(*a*)(*vi*) shows an alternative or additional method step involved in assembling the inertial exciter 101*a* in which apertures are incorporated into the frame 120*a* to allow a centering jig 196*a* to be inserted into the apertures during assembly, e.g. to help with aligning the voice coil former 132*a* in the air gap 116*a*.

Preferably the voice coil assembly (including the coupling element 150*am* the voice coil 130*a*, voice coil former 132*a* and the tubular member 140*a*) could be pre-assembled on a separate jig (not shown) before being assembled in the magnet assembly 102*a*.

Various alternative inner magnet examples will now be described. Alike features have been given alike reference numerals where appropriate and are not described in further detail, except where necessary.

A second inertial exciter 101*b* that exemplifies an inertial exciter of the inner magnet type is shown in FIG. 4(*b*)(*i*).

The coupling element 150*b* of the inertial exciter 101*b* is shown in FIG. 4(*b*)(*ii*) and includes bayonet features in the form of radial extensions 151*b* configured to engage with corresponding bayonet features 191*b* on the acoustic radiator 190*b* shown in FIG. 4(*b*)(*iii*) to provide a bayonet attachment between the coupling element 150*b* and the acoustic radiator 190*b*. The bayonet features 191*b* on the acoustic radiator preferably form slots for accommodating the radial extensions 151*b*. The resulting loudspeaker 180*b* is shown in FIG. 4(*b*)(*iv*).

The above-described bayonet feature could facilitate assembly and replacement of the inertial exciter 101*b* to the acoustic radiator 190*b*.

The above-described bayonet features could be combined with adhesives or filler (e.g. grease) to avoid rattling during operation. The adhesive or filler could have temperature dependent properties so that by applying heat the inertial exciter 101*b* can be replaced.

A third inertial exciter 101*c* that exemplifies an inertial exciter of the inner magnet type is shown in FIG. 4(*c*).

In this example, the tubular member 140*c* includes a collar 141*c* that provides a flat face to facilitate gluing of the first suspension 160*c*, which in this example could be a fabric damper, a metal or plastic spiral spring, a rubber element, etc.

A fourth inertial exciter 101*d* that exemplifies an inertial exciter of the inner magnet type is shown in FIG. 4(*d*).

In this example, the a ring 141*d*, e.g. made of cardboard or plastic, is attached to the distal portion of the tubular member 140*d* to provide a flat surface 141*d* to facilitate gluing of the first suspension 160*d*.

A fifth inertial exciter 101*e* that exemplifies an inertial exciter of the inner magnet type is shown in FIG. 4(*e*).

In this example, the tubular member 140*e* is integrally formed with the attachment portion 150*e* by appropriately shaping the tubular member 140*e* to include the attachment portion 150*e*. This allows the tubular member 140*e* to be glued directly to the voice coil former 132*e*, and avoids the use of a coupling element as described in previous examples. In this example, the attachment portion 150*e* is a flat face of the tubular member 140*e* that is configured to be glued to the acoustic radiator (not shown).

The tubular member 140*e* could be made of paper, cardboard, Kapton, aluminium, kevlar, PE, ABS etc.

A sixth inertial exciter 101*f* that exemplifies an inertial exciter of the inner magnet type is shown in FIG. 4(*f*).

The inertial exciter 101*f* is the same as the fifth inertial exciter 101*e* shown in FIG. 4(*e*), except that holes are formed in the attachment portion 150*f* to enhance the glue attachment to the acoustic radiator (not shown).

A seventh inertial exciter 101*g* that exemplifies an inertial exciter of the inner magnet type is shown in FIG. 4(*g*).

In this example, the coupling element 150*g* is attached only to the voice coil former 132*g*, with the tubular member 140*g* being attached to the voice coil former 132*g*.

An eighth inertial exciter 101*h* that exemplifies an inertial exciter of the inner magnet type is shown in FIG. 4(*h*).

In this example, the tubular member 140*h* forms an angle with respect to the movement axis, thereby forming a frusto-conical tubular member 140*h*. In this case, the angle is preferably no more than 15°.

A tubular member 140*h* shaped in this way could facilitate the making of the tubular member 140*h* from paper or from plastic in a deep draw process.

In this example, the tubular member 140*h* is again integrally formed with the attachment portion 150*h* by appropriately shaping the tubular member 140*h* to include the attachment portion 150*h*.

A ninth inertial exciter 101*i* that exemplifies an inertial exciter of the inner magnet type is shown in FIG. 4(*i*)(*i*).

This example is essentially the same as the first inertial exciter 101*a* shown in FIG. 4(*a*)(*i*), except that in this case the first and second suspensions 160*i*, 165*i* include only a single corrugation, and the single corrugations mirror each other (in a plane 108*i* perpendicular to the movement axis 106*i*) to help cancel asymmetries in stiffness between the two suspensions 160*i*, 165*i*. The first and second suspensions 160*i*, 165*i* may in this case be roll suspensions, e.g. made of rubber, textile or foam.

FIG. 4(*i*)(*ii*) show the attachment between the frame 120*i* and the suspensions 160*i*, 165*i*. In this particular example, the rim of the frame 120*i* is provided in two parts, 124*i*(*i*) and 124*i*(*ii*).

Example dimensions are drawn on FIG. 4(*i*)(*i*) and FIG. 4(*i*)(*ii*), noting that the distance between locations at which the two suspensions 160*i*, 165*i* attach to the rim of the magnet assembly is 6.3 mm in this example, which is large given the overall size of the inertial exciter 101*i*.

FIGS. 4(*i*)(*iii*)-(viii) are 3D views showing the inertial exciter 101*i* from various angles.

A tenth inertial exciter 101*j* that exemplifies an inertial exciter of the inner magnet type is shown in FIG. 4(*j*)(*i*).

The inertial exciter 101*j* shown in FIG. 4(*j*)(*i*) is the same as the inertial exciter 101*a* shown in FIG. 4(*a*)(*i*) except that the inertial exciter includes an alternative form of first and second suspensions 160*j*, 165*j*.

The alternative form of suspension used for the first and second suspensions 160*j*, 165*j* is shown in more detail in FIG. 4(*j*)(*ii*).

As can be seen most clearly from FIG. 4(*j*)(*ii*), the alternative form of first and second suspensions 160*j*, 165*j* is a piece of sheet material having a geometry configured to allow deflection in a direction parallel to the movement axis 106*j*, whilst inhibiting movement in a direction perpendicular to the movement axis 106*j*.

A suitable material for the alternative form of first and second suspensions 160*j*, 165*j* could be a fiber-reinforced plastic, e.g. a polymer matrix reinforced with glass fibres or carbon fibres, or a metal, e.g. steel spring material.

An eleventh inertial exciter 101*k* that exemplifies an inertial exciter of the inner magnet type is shown in FIG. 4(*k*).

The inertial exciter 101*k* shown in FIG. 4(*k*) is the same as the inertial exciter 101*a* shown in FIG. 4(*a*)(*i*) except that in this example the second suspension 165*k* is attached to a proximal portion of the voice coil former 132*k* and a proximal portion of a part of the magnet assembly positioned radially inwardly of the voice coil former (in this case the extra magnet 114*k*).

Note, that in this case the inertial exciter 101*k* has:

a first suspension 160*k* that is attached to a distal portion of the tubular member 140*k* and the distal portion of the rim 124*k;* and a second suspension 165*k* that is attached to a proximal portion of the voice coil former 132*k* and a proximal portion of a part of the magnet assembly positioned radially inwardly of the voice coil former 132*k* (in this case the extra magnet 114*k*).

Thus, this arrangement still allows for a wide separation between the first and second suspensions 160*k*, 165*k,* thereby helping to inhibit rotation of the magnet assembly 102*k* relative to the voice coil assembly 104*k*.

Besides providing suspension, the second suspension 165*k* can also serve as a dust cover to prevent dust in the airgap 116*k* prior to mounting the inertial exciter 101*k* to an acoustic radiator.

In this example, the first suspension 165*k* is a roll suspension including only one corrugation.

A twelfth inertial exciter 101*l* that exemplifies an inertial exciter of the inner magnet type is shown in FIG. 4(*l*).

The inertial exciter 101*l* shown in FIG. 4(*l*) is the same as the inertial exciter 101*a* shown in FIG. 4(*a*)(*i*) except that a third suspension 168*l* is attached to a proximal portion of the voice coil former 132*l* and a proximal portion of a part of the magnet assembly positioned radially inwardly of the voice coil former (in this case the extra magnet 114*l*).

Besides providing suspension, the third suspension 168*l* can also serve as a dust cover to prevent dust in the airgap 116*l* prior to mounting the inertial exciter 101*l* to an acoustic radiator.

Inertial Exciter—Outer Magnet Type Examples

A first inertial exciter 201*a* that exemplifies an inertial exciter of the outer magnet type is shown in FIG. 5(*a*).

The inertial exciter 201*a* shown in FIG. 5(*a*) includes many features which are common to the inertial exciter 101*a* shown in FIG. 4(*a*)(*i*). Alike features have been given alike reference numerals where appropriate and are not described in further detail, except where necessary.

The magnet assembly 202*a* includes a magnet unit 210*a* and a frame 220*a* to which the magnet unit 210*a* is attached.

In this example, the magnet unit 210*a* includes a (ring-shaped) main magnet 212*a,* a (ring-shaped) washer 213*a* and a T-yoke 215*a* (which looks like an upside down "T" as drawn). The magnet unit 210*a* is configured to provide a magnetic field in an air gap 216*a*. The air gap 216*a* extends around a movement axis 206*a* of the inertial exciter 201*a*.

The outer magnet type examples can be useful as they allow more magnet material to be used compared with the inner magnet type examples, and therefore enable more powerful exciters, as may be desirable in some cases.

In this example, the frame 220*a* includes a base portion 222*a* which extends radially inwardly with respect to the movement axis 206*a* (in this example from a base of the T-yoke 215*a*).

In this example, the frame 220*a* also include a hub 224*a* which extends axially with respect to the movement axis 206*a,* that is at least partly along the movement axis 206*a*. The hub 224*a* of the frame 220*a* is positioned at the centre of the base portion 222*a,* and is positioned radially inwardly of the tubular member 240*a*.

In this example, the tubular member 240*a* is positioned radially inwardly of the voice coil former 232*a* with respect to the movement axis 206*a,* and overlaps the voice coil former 232*a* along at least a portion of the movement axis 206*a*.

The inertial exciter 201*a* includes:

a first suspension 260*a* that is attached to a distal portion of the tubular member 240*a* and the distal portion of the hub 224*a;* and a second suspension 265*a* that is attached to the proximal portion of the tubular member 240*a* and the proximal portion of the hub 224*a*.

The proximal portions of the tubular member 240*a* and hub 224*a* are located between the first plane 208*a* and the second plane 209*a* as defined above. The proximal portions of the tubular member 240*a* and hub 224*a* are located on an opposite side of the second plane 209*a* from the proximal portions.

As can be seen from FIG. 5(*a*), the hub 224*a* of the frame 220*a* includes a first ledge 225*a* to which the first suspension 260*a* is attached, and a second ledge 226*a* to which the second suspension 265*a* is attached.

In this example, the inertial exciter 201*a* includes a lead wire 234*a* configured to provide an electrical path for supplying an electrical current carrying an audio signal (representative of sound) to the voice coil 130*a*.

In this example, the electrical path provided by the lead wire 234*a* extend from a connector 238*a* formed on an outwardly facing surface of the base portion 222 of the frame 220*a* (outward in the sense of facing away from the hub 224*a*) to the voice coil 230*a*.

In this example, the lead wire 234*a* extends through the frame 220*a*.

In this example, the coupling element 250*a* is similar to that shown in FIG. 4(*a*)(*i*).

In use, electrical current carrying an audio signal is supplied to the voice coil 230*a* via the connector 238*a* and lead wire 234*a*. This energises the voice coil 230*a* and causes a magnetic field to be produced by the current in the voice coil 230*a,* which interacts with the magnetic field produced in the air gap 216*a* by the magnet unit 210*a,* and causes the voice coil assembly 204*a* to move relative to the magnet assembly 202*a*. This relative movement is accommodated by the first and second suspensions 260*a,* 265*a*.

Various alternative inner magnet examples will now be described. Alike features have been given alike reference numerals where appropriate and are not described in further detail, except where necessary.

A second inertial exciter 201*b* that exemplifies an inertial exciter of the outer magnet type is shown in FIG. 5(*b*).

This example is that same as that shown in FIG. 5(*a*), except that a third suspension 268*b* is attached to the voice coil former 232*b* and to a part of the magnet assembly 202*b* (in this case the washer 213*b*) positioned radially outwardly of the voice coil former 232*a*.

Besides providing suspension, the third suspension 268*b* can also serve as a dust cover to prevent dust in the airgap 216*b* when the inertial exciter 201*b* is in use.

A third inertial exciter 201*c* that exemplifies an inertial exciter of the outer magnet type is shown in FIG. 5(*c*).

This example is that same as that shown in FIG. 5(*a*), except that in this example the second suspension 265*c* is attached to the voice coil former 232*b* and to a part of the magnet assembly 202*b* (in this case the washer 213*b*) positioned radially outwardly of the voice coil former 232*a*.

Note, that in this case the inertial exciter 201*c* has:

a first suspension 260*c* that is attached to a distal portion of the tubular member 240*c* and the distal portion of the hub 224*c;* and an second suspension 265*c* that is attached to a proximal portion of the tubular member 240*c* and a proximal portion of a part of the magnet assembly positioned radially outwardly of the tubular member 240*c* (in this case the washer 213*b*).

Thus, this arrangement still allows for a wide separation between the first and second suspensions 160*k*, 165*k*, thereby helping to inhibit rotation of the magnet assembly 202*c* relative to the voice coil assembly 204*c*.

Besides providing suspension, the second suspension 265*c* can also serve as a dust cover to prevent dust in the airgap 216*c* when the inertial exciter 201*b* is in use.

A fourth inertial exciter 201*d* that exemplifies an inertial exciter of the outer magnet type is shown in FIG. 5(*d*).

This example is that same as that shown in FIG. 5(*b*), except that:

the tubular member 240*d* is integrally formed with the attachment portion 250*d* by appropriately shaping the tubular member 240*d* to include the attachment portion 250*d*.

holes are formed in the attachment portion 250*d* to enhance the glue attachment to the acoustic radiator (not shown)

Drive Unit—Inner Magnet Type Example

Figure 6A:
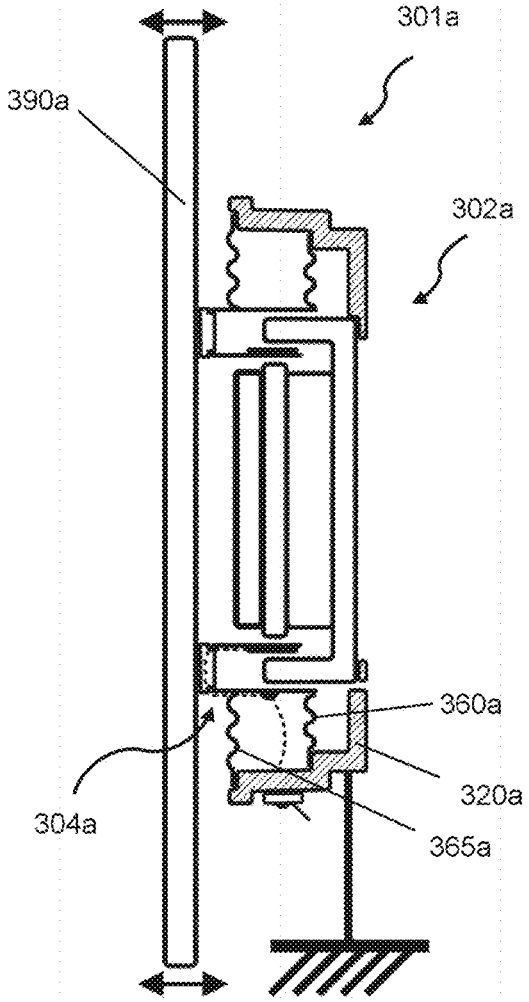
FIG. 6(*a*) shows a drive unit that exemplifies a drive unit of the inner magnet type.
Figure 6B:
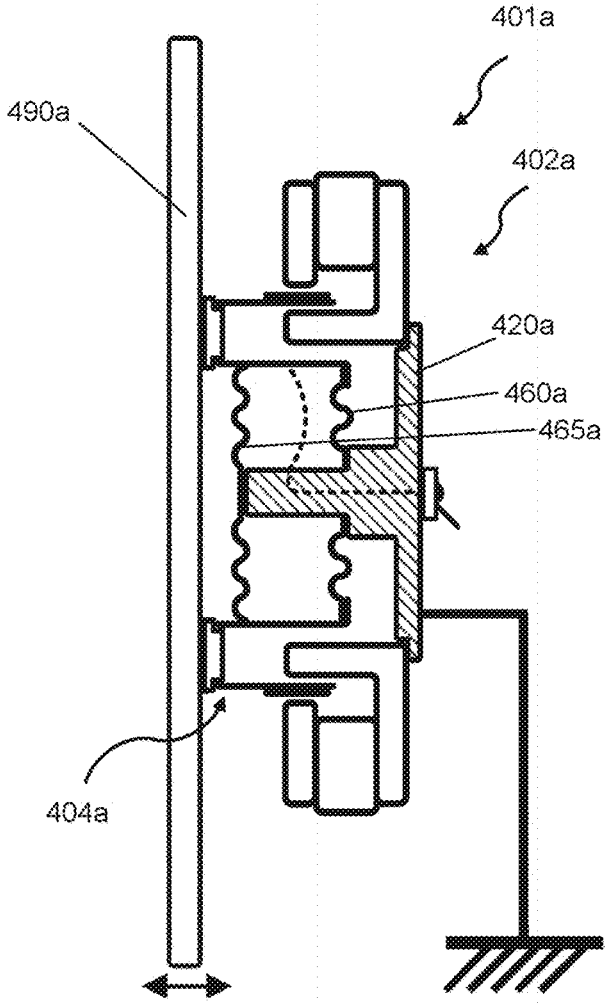

A drive unit 301*a* that exemplifies a drive unit of the inner magnet type is shown in FIG. 6(*a*).

The construction of the drive unit 301*a* is essentially the same as the inertial exciter 101*a* of the inner magnet type shown in FIG. 4(*a*)(*i*), with alike features being given alike reference numerals that do not need to be described further here.

A key difference from the inertial exciter 101*a* shown in FIG. 4(*a*)(*i*) is that the magnet assembly 302*a* of the drive unit 301*a* shown here is grounded, i.e. with the magnet assembly 302*a* (preferably the frame 320*a* of the magnet assembly 302*a*) being rigidly attached to an external body, preferably a frame from which the acoustic radiator 390*a* is suspended.

Thus, the acoustic radiator 390*a* is suspended from the magnet assembly 302*a* via the coil assembly 304*a* by the first and second suspensions 360*a*, 365*a*, rather than magnet assembly 302*a* being suspended from the acoustic radiator 390*a*.

Of course, any of the inertial exciters of the inner magnet type as shown in any of the preceding drawings could be configured for use as a drive unit in this way.

As noted previously, this arrangement helps to provide stable pistonic movement of the acoustic radiator 390*a* and reduces rocking of the acoustic radiator 390*a*, and also takes up a small surface area on a radiating surface of the acoustic radiator 390*a* and thus is particularly useful in a dipole loudspeaker.

Drive Unit—Outer Magnet Type Example

A drive unit 401*a* that exemplifies a drive unit of the outer magnet type is shown in FIG. 6(*b*).

The construction of the drive unit 401*a* is essentially the same as the inertial exciter 201*a* of the outer magnet type shown in FIG. 5(*a*), with alike features being given alike reference numerals that do not need to be described further here.

A key difference from the inertial exciter 201 shown in FIG. 5(*a*) is that the magnet assembly 402*a* of the drive unit 401*a* shown here is grounded, i.e. with the magnet assembly 402*a* (preferably the frame 420*a* of the magnet assembly 402*a*) being rigidly attached to an external body, preferably a frame from which the acoustic radiator is suspended.

Thus, the acoustic radiator 490*a* is suspended from the magnet assembly 402*a* via the coil assembly 404*a* by the first and second suspensions 460*a*, 465*a*, rather than magnet assembly 402*a* being suspended from the acoustic radiator 490*a*.

Of course, any of the inertial exciters of the outer magnet type as shown in any of the preceding drawings could be configured for use as a drive unit in this way.

As noted previously, this arrangement helps to provide stable pistonic movement of the acoustic radiator 490*a* and reduces rocking of the acoustic radiator 490*a*, and also takes up a small surface area on a radiating surface of the acoustic radiator 490*a* and thus is particularly useful in a dipole loudspeaker.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventor does not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

REFERENCES

A number of publications are cited above in order to more fully describe and disclose the invention and the state of the art to which the invention pertains. Full citations for these references are provided below.

The entirety of each of these references is incorporated herein.

[1] U.S. Pat. No. 6,618,487B1
[2] U.S. Pat. No. 4,506,117A
[3] U.S. Pat. No. 8,247,930B2
[4] U.S. Pat. No. 7,372,968B2
[5] U.S. Pat. No. 4,550,428A
[6] U.S. Pat. No. 6,965,679B1
[7] US2005/180587A1
[8] U.S. Pat. No. 4,675,907A
[9] U.S. Pat. No. 4,354,067A
[10] U.S. Pat. No. 4,750,208A
[11] DE102004009902A1
[12] U.S. Pat. No. 9,621,994B1
[13] U.S. Pat. No. 5,734,132

The invention claimed is:

1. An inertial exciter for use with an acoustic radiator, the inertial exciter comprising:

a magnet assembly including a magnet unit configured to provide a magnetic field in an air gap, wherein the air gap extends around a movement axis of the inertial exciter;

a coil assembly including:

an attachment portion configured to provide an attachment between the coil assembly and the acoustic radiator;

a voice coil;

a voice coil former which extends from the attachment portion into the air gap, wherein the voice coil is mounted to the voice coil former so that the voice coil sits in the air gap when the inertial exciter is at rest;

a tubular member, which is positioned radially outwardly of the voice coil former with respect to the movement axis, and which overlaps the voice coil former along at least a portion of the movement axis;

a first suspension attached to the tubular member and a part of the magnet assembly, wherein the part of the magnet assembly attached to the first suspension is positioned radially outwardly of the tubular member; and a second suspension, separated from the first suspension in a direction extending parallel to the movement axis, wherein the second suspension is either: attached to the tubular member and the part of the magnet assembly positioned radially outwardly of the tubular member, or is attached to the voice coil former and a part of the magnet assembly positioned radially inwardly of the voice coil former;

wherein the inertial exciter is configured so that, when the coil assembly is attached to the acoustic radiator via the attachment portion, the magnet assembly is suspended from the acoustic radiator via the coil assembly by the first and second suspensions.

2. An inertial exciter according to claim 1, wherein:

the first suspension is attached to a distal portion of the tubular member and a distal portion of the part of the magnet assembly positioned radially outwardly of the tubular member.

3. An inertial exciter according to claim 2, wherein:

the second suspension is attached to a proximal portion of the tubular member and a proximal portion of the part of the magnet assembly positioned radially outwardly of the tubular member.

4. An inertial exciter according to claim 3, wherein:

a third suspension is attached to a proximal portion of the voice coil former and a proximal portion of a part of the magnet assembly positioned radially inwardly of the voice coil former.

5. An inertial exciter according to claim 2, wherein:

the second suspension is attached to a proximal portion of the voice coil former and a proximal portion of a part of the magnet assembly positioned radially inwardly of the voice coil former.

6. An inertial exciter according to claim 1, wherein the magnet assembly includes a frame to which the magnet unit is attached, wherein the part of the magnet assembly positioned radially outwardly of the tubular member is a part of the frame.

7. An inertial exciter for use with an acoustic radiator, the inertial exciter comprising:

a magnet assembly including a magnet unit configured to provide a magnetic field in an air gap, wherein the air gap extends around a movement axis of the exciter;

a coil assembly including:

an attachment portion configured to provide an attachment between the coil assembly and the acoustic radiator;

a voice coil;

a voice coil former which extends from the attachment portion into the air gap, wherein the voice coil is mounted to the voice coil former so that the voice coil sits in the air gap when the inertial exciter is at rest;

a tubular member, which is positioned radially inwardly of the voice coil former with respect to the movement axis, and which overlaps the voice coil former along at least a portion of the movement axis;

at least one suspension attached to the tubular member and a part of the magnet assembly wherein the part of the magnet assembly attached to the first suspension is positioned radially inwardly of the tubular member; and a second suspension, separated from the first suspension in a direction extending parallel to the movement axis, wherein the second suspension is either: attached to the tubular member and the part of the magnet assembly positioned radially outwardly of the tubular member, or is attached to the voice coil former and a part of the magnet assembly positioned radially inwardly of the voice coil former;

wherein the inertial exciter is configured so that, when the coil assembly is attached to the acoustic radiator via the attachment portion, the magnet assembly is suspended from the acoustic radiator via the coil assembly by the first and second suspensions.

8. An inertial exciter according to claim 7, wherein:

the first suspension is attached to a distal portion of the tubular member and a distal portion of the part of the magnet assembly positioned radially inwardly of the tubular member.

9. An inertial exciter according to claim 8, wherein:

the second suspension is attached to a proximal portion of the tubular member and a proximal portion of the part of the magnet assembly positioned radially inwardly of the tubular member.

10. An inertial exciter according to claim 9, wherein:

a third suspension is attached to a proximal portion of the voice coil former and a proximal portion of a part of the magnet assembly positioned radially outwardly of the voice coil former.

11. An inertial exciter according to claim 8, wherein:

the second suspension is attached to a proximal portion of the voice coil former and a proximal portion of a part of the magnet assembly positioned radially outwardly of the voice coil former.

12. An inertial exciter according to claim 7, wherein the magnet assembly includes a frame to which the magnet unit is attached, wherein the part of the magnet assembly positioned radially inwardly of the tubular member is a part of the frame.

13. An inertial exciter according to claim 1, wherein the tubular member is shaped to include the attachment portion, and optionally the voice coil former.

14. An inertial exciter according to claim 1, wherein the tubular member has one or more extensions in a radial direction with respect to the movement axis to provide a respective attachment surface for the/each suspension attached to the tubular member, thereby facilitating attachment of the/each suspension to the tubular member.

15. An inertial exciter according to claim 1, wherein the attachment portion is a coupling element which is separately attached to the voice coil former and/or tubular member.

16. An inertial exciter according to claim 1, wherein the attachment portion is configured to provide an attachment between the coil assembly and the acoustic radiator by including bayonet features configured to engage with corresponding bayonet features on the acoustic radiator to provide a bayonet attachment between the attachment portion and the acoustic radiator.

17. An inertial exciter according to claim 1, wherein the inertial exciter includes one or more wires configured to provide an electrical path for supplying an electrical current carrying an audio signal (representative of sound) to the voice coil, wherein:

the electrical path provided by the one or more wires extends from a connector formed on the magnet assembly to the voice coil; and/or the one or more wires include a wire that passes through or around the tubular member, wherein optionally a coupling element is configured to guide said wire through or around the tubular member; and/or the one or more wires may include a wire that passes through a frame included in the magnet assembly.

18. An inertial exciter according to claim 1, wherein the inertial exciter is part of a loudspeaker including an acoustic radiator, wherein the coil assembly of the inertial exciter is attached to the acoustic radiator via the attachment portion so that the magnet assembly is suspended from the acoustic radiator via the coil assembly via the at least one suspension.

19. An inertial exciter according to claim 7, wherein the tubular member is shaped to include the attachment portion, and optionally the voice coil former.

20. An inertial exciter according to claim 7, wherein the tubular member has one or more extensions in a radial direction with respect to the movement axis to provide a respective attachment surface for the/each suspension attached to the tubular member, thereby facilitating attachment of the/each suspension to the tubular member.

21. An inertial exciter according to claim 7, wherein the attachment portion is a coupling element which is separately attached to the voice coil former and/or tubular member.

22. An inertial exciter according to claim 7, wherein the attachment portion is configured to provide an attachment between the coil assembly and the acoustic radiator by including bayonet features configured to engage with corresponding bayonet features on the acoustic radiator to provide a bayonet attachment between the attachment portion and the acoustic radiator.

23. An inertial exciter according to claim 7, wherein the inertial exciter includes one or more wires configured to provide an electrical path for supplying an electrical current carrying an audio signal (representative of sound) to the voice coil, wherein:

the electrical path provided by the one or more wires extends from a connector formed on the magnet assembly to the voice coil; and/or the one or more wires include a wire that passes through or around the tubular member, wherein optionally a coupling element is configured to guide said wire through or around the tubular member; and/or the one or more wires may include a wire that passes through a frame included in the magnet assembly.

24. An inertial exciter according to claim 7, wherein the inertial exciter is part of a loudspeaker including an acoustic radiator, wherein the coil assembly of the inertial exciter is attached to the acoustic radiator via the attachment portion so that the magnet assembly is suspended from the acoustic radiator via the coil assembly via the at least one suspension.

* * * * *